US005472153A

United States Patent [19]

Crowley et al.

[11] Patent Number: 5,472,153

[45] **Date of Patent: * Dec. 5, 1995**

[54] ROLL SUPPORT AND FEED APPARATUS

[75] Inventors: H. W. Crowley, Newton; R. Langdon Wales, deceased, late of Lincoln, both of Mass., by Ruth Wales, executrix

[73] Assignee: Roll Systems, Inc., Burlington, Mass.

[ * ] Notice: The portion of the term of this patent subsequent to Sep. 6, 2011, has been disclaimed.

[21] Appl. No.: 300,371

[22] Filed: Sep. 2, 1994

Related U.S. Application Data

[63] Continuation of Ser. No. 647,545, Jan. 29, 1991, Pat. No. 5,344,089, which is a continuation-in-part of Ser. No. 452, 245, Dec. 18, 1989, Pat. No. 5,000,394, which is a continuation of Ser. No. 136,812, Dec. 22, 1987, Pat. No. 4,893,763.

[51] Int. Cl.[6] ..... B65H 16/10; B65H 23/185

[52] U.S. Cl. ..... 242/420.3; 242/420.6; 242/559.4; 242/564.5; 242/596.1

[58] Field of Search ..... 242/420.3, 420.6, 242/418, 557, 559, 559.4, 564.5, 596.1

[56] References Cited

U.S. PATENT DOCUMENTS 2,355,441 8/1944 Jacob ..... 242/557

3,038,681 6/1962 Herr ..... 242/420.6

*Primary Examiner*—John M. Jillions

*Attorney, Agent, or Firm*—Wolf, Greenfield & Sacks

[57] ABSTRACT

A machine for feeding rolls of web material to a utilization device that is adapted to draw the web material into the utilization device. The roll machine includes a frame carrying a carriage that supports a pair of arms having respective chucks that are adapted to move toward and away from each other for engaging and disengaging with the core of a roll that is being supported and fed. An overhead drive arrangement is used for driving the periphery of the roll in combination with a torque roller for maintaining tension in the web. A gravity loop of the material has its position sensed for control of the roll drive means in a manner to match the rate of use by the utilization device. The drive arrangement may also include a motor that directly drives the roll core. The chucks driving the roll core may further be adaptable to variably support various roll core diameters and may include structures for positively gripping the core.

18 Claims, 17 Drawing Sheets

7
4
6
90
86
67
105
85
70
80
78
83
88
71
73
84
72
75
77
82
14
A
100
64
39
36
28
102
30
5
10
24
20
13
12
16
120
122
25
22
23

7
6
85
67
84
71
80
83
78
73
45
42
72
70
64
39
14
75
82
30
77
74
36
28
102
A
24
10
12

9
8
90
90
85
67
67
73
10
84
52
54
9
42
42
64
58
37
60A
62
60
60B
57
39
40
57
38
36
42
42
28
28
24
24
48
20
49
50
25
22
22
23
23
8

Fig. 9
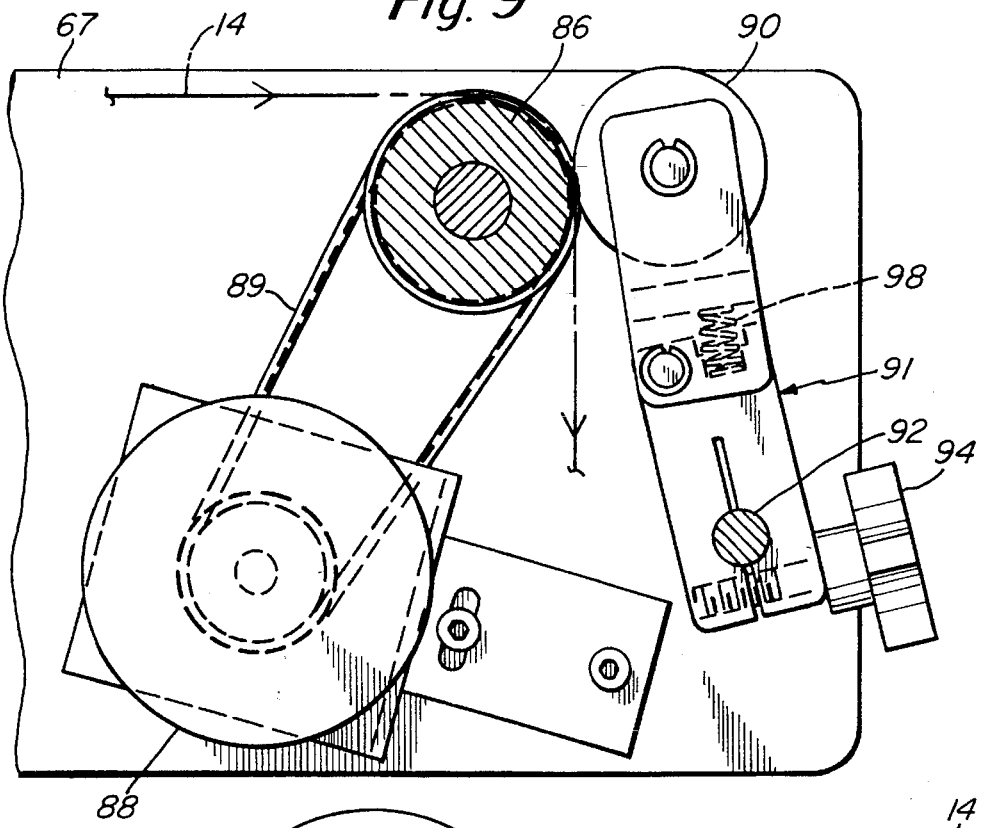
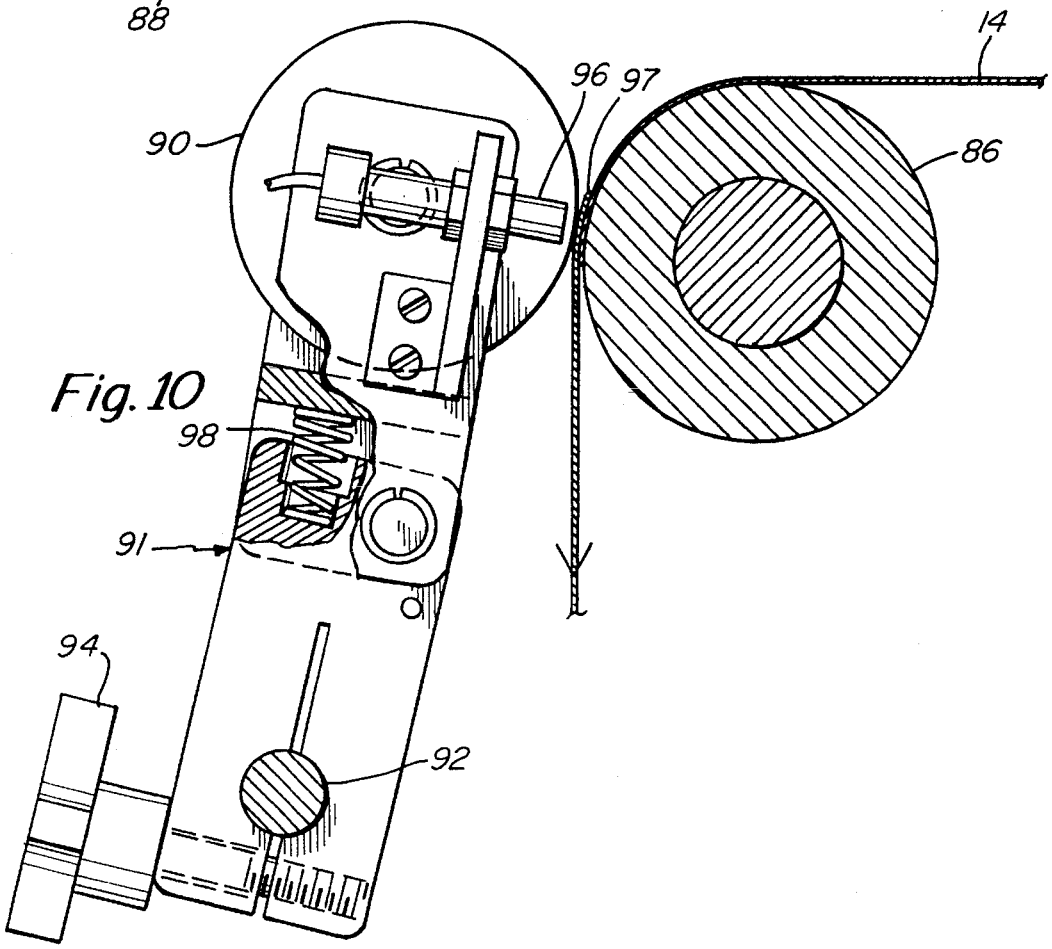
Fig. 10

Fig. 11
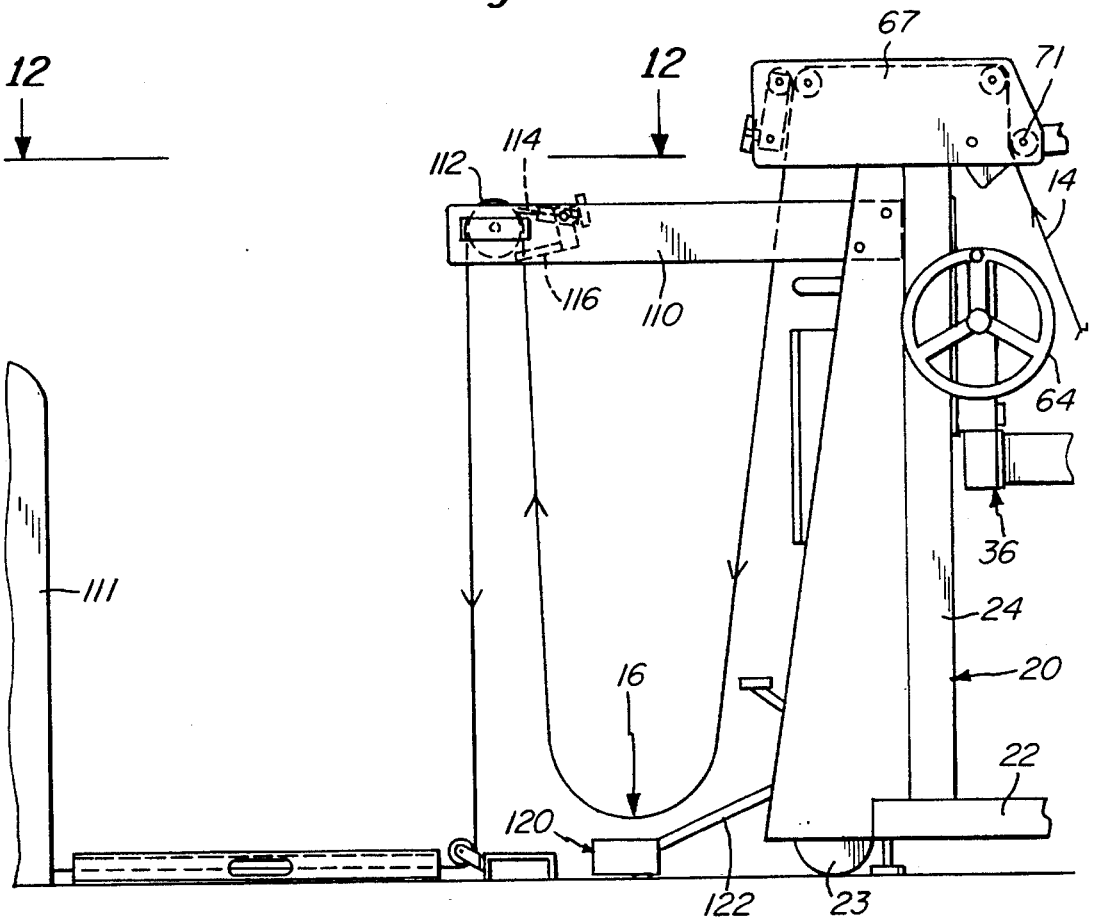
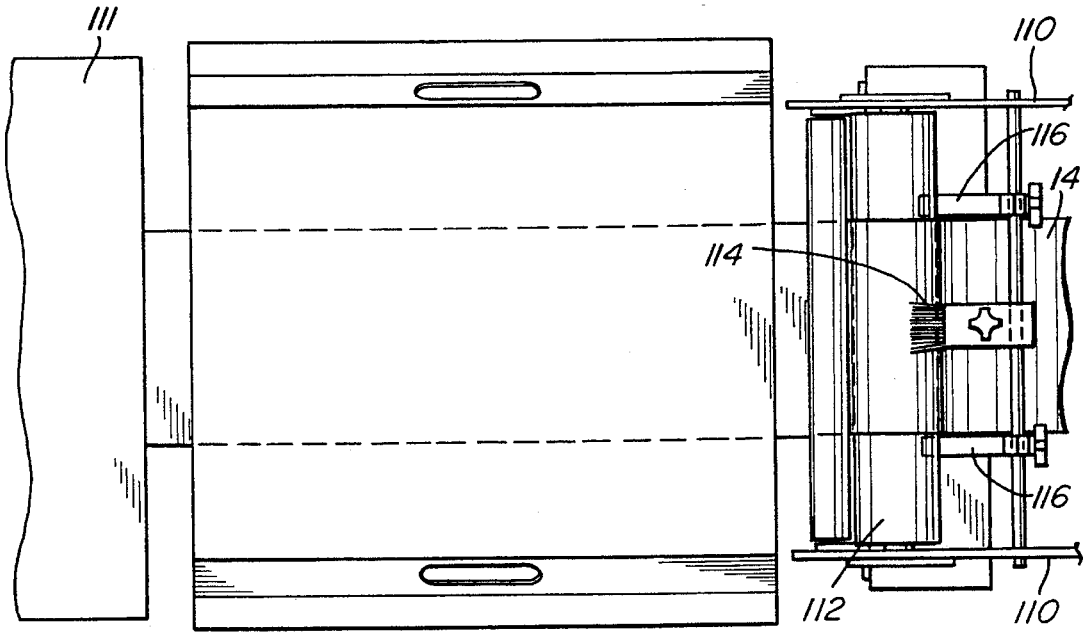
Fig. 12

ROLL SUPPORT AND FEED APPARATUS

This application is a continuation of application Ser. No. 07/647,545 filed on Jan. 29, 1991, now U.S. Pat. No. 5,344,089, (which in turn is a continuation-in-part of application Ser. No. 07/452,245 filed on Dec. 18, 1989, now U.S. Pat. No. 5,000,394, issued on Mar. 19, 1991, which is a continuation of application Ser. No. 07/136,812 filed on Dec. 22, 1987, now U.S. Pat. No. 4,893,763, issued on Jan. 16, 1990).

BACKGROUND OF THE INVENTION

I. Related Applications

This application relates to the following prior applications:

U.S. Ser. No. 07/452,245 filed Dec. 18, 1989, now U.S. Pat. No. 5,000,394;

U.S. Ser. No. 07/136,812 filed Dec. 22, 1987, now U.S. Pat. No. 4,893,763.

II. Field of the Invention

The present invention relates in general to an apparatus for supporting and feeding a web material from a roll. More particularly, the present invention relates to a roll supporting and feeding apparatus that is preferably portable and that is capable of readily receiving a roll having a support core. The apparatus supports the web material in a roll for feeding to a utilization means that draws the webbed material thereto.

III. Background of the Invention

There are several types of prior art roll feeding machines. Many of these machines are of relatively complicated structure and these machines tend to generally be relatively expensive., These prior art machines also tend to be relatively limited in application and are not readily usable for universal applications.

One of the significant drawbacks associated with prior art roll feeding machines relates to the manner in which the roll is supported in the machine. The prior art machines employ a roll core shaft. These shafts represent an extra component that must be assembled in order to handle the roll. The core shafts are very heavy and are easily damaged if dropped. They are also expensive to replace or repair. These mechanical core shafts tend to get their tightened head worn out from the constant use of a tool. With respect to the air filled core shafts they require the use of clean air. They also suffer from rupture of or leakage from their bladder. Moreover, in the use of these core shafts, the shafts are quite apt to get stuck in the cores. They provide cleats that dig Into the cardboard cores and thus are difficult to dislodge. This is in particular one of the major problems with the air operated core shafts because they depend on springs to retract them. When the shaft is stuck it has to be driven out causing further destruction of the shaft.

With the previous use of core shafts, the loading of a new roll requires extra time to remove the shaft from the old roll and replace it with a new one, or alternatively, spare shafts must be employed. The spare shaft is a safety problem because it tends to be in the way in the general work area. A further problem associated with the use of core shafts is that it assumes that the core is in undamaged condition and of essentially perfect shape to accept the shaft. If a core is damaged at any place along the length thereof then there is extreme difficulty in properly inserting the core shaft into the core.

Even once the core shaft is inserted in the roll core, the shaft engagement into the machine in these prior art machines furthermore requires intense operator attention. If a shaft is mounted improperly and gets out of its socket then the heavy roll may dangerously roll across the floor. Also, the shaft mounted roll requires the roll to be put precisely into the center of the shaft. Otherwise the paper runs off-center.

Accordingly, it is an object of the present invention to provide an improved means for roll support, one that in particular, does not require the use of core shafts and one that provides for essentially automatic roll alignment in the machine.

The prior art roll machines also provide means for speed matching with the machine into which the roll is being fed. These prior art machines rely upon a weighted bar or dancer that rides on the web and is pivoted to hold the web in place. A sensor is then employed to detect the position of the weight (dancer). This weighted bar approach may be adequate for some applications. However, when used, in particular, with say impact printers or bursters, which have widely varying speeds, then this prior art arrangement is quite inadequate.

The weighted bar device puts substantial strain on the pin feed holes. Even with the weight counterbalanced, the speed changes cause inertia forces that distort the pin feed holes. This tension complicates the paper steering operation. This requires exact alignment and trim.

Accordingly, another object of the present invention is to provide an improved apparatus for supporting and feeding web material from a roll in which there is provided improved speed matching with the utilization machine. The technique of the present invention preferably eliminates the use of a weight bar and thus does not require any special alignment.

Still another object of the present invention is to provide an improved speed matching control for a roll feed machine that employs an analog form of detection including a position detector means responsive to the position of a gravity loop of web material.

A further object of the present invention is to provide a sensor in accordance with the preceding object which is preferably a non-contact sound sensor having no moving parts that could wear out.

Another problem associated with prior art machines is the "telescoping" of rolls. The prior art machines have several problems with telescoping, especially with narrow width webs and with rolls larger than two feet in diameter. The propensity of these prior art machines to telescope these large diameter rolls leads to a substantial web material waste. One prior art machine employs a complex controller that accelerates and stops the roll by a gear on the shaft. This has several problems. The shaft has to be in good condition or it looses its grip and therefore its control on the roll. The shaft force has to have a ten to one variation to provide uniform force on the surface of the web as the radius changes as the roll runs down. This is complicated and not particularly accurate. With this prior art machine it is particularly troublesome when starting and stopping because the inertia is a complex function of the radius which changes as the roll runs down. With this prior art machine the starting and stopping action on the core can rip the first layer of paper after the core. This happens most often on a heavy new roll. This means that a large roll is ruined because it is slipping in the layers of paper behind the cardboard core. The use of a shaft that is poorly installed or damaged can ream out the core inside and ruin the roll. If the shaft is not properly expanded by the operator, the roll of paper may get out of control and dump substantial amounts of waste on the floor.

Accordingly, a further object of the present invention is to provide an improved drive technique for a roll feeding machine and one which in particular eliminates the aforementioned problem of the "telescoping" of the roll.

An additional object of the present invention is to provide a unique chuck structure for insertion in the roll core that allows the chuck to be used with various diameter cores and that also establishes a firm grip on the core in the event that the chucks themselves are provided with driving power.

Still another object of the present is to provide an improved apparatus for supporting and feeding web material from the roll in which the apparatus is relatively light, drives the roll without marking the roll, is easy to service and maintain, and is of simplified construction particularly as it relates to setting up a roll for feeding.

SUMMARY OF THE INVENTION

To accomplish the foregoing and other objects, features and advantages of the invention there is provided an apparatus for supporting and feeding web material from a roll. This web material may be paper material or may be other forms of web material generally supported on a support core. The roll is adapted to be supported and fed to utilization means that draws the web material thereto. This utilization means may be a printer, burster, collator, inserter, or other like machines.

The apparatus of the present invention comprises a frame and means for supporting the frame in a manner to enable the frame to be moved about. In a disclosed embodiment a plurality of support wheels are provided that enable the frame to be rolled about. The frame is constructed of relatively light weight metal so that it is strong and rigid yet of relatively light weight construction. Arm means carrying chuck means is supported from the frame. The chuck means is for receiving the roll core for support of the web material roll. With the use of support chucks, rather than a core shaft, only a few outer inches of the core are engaged. These chucks are tapered so that they insert easily and self-center the roll core therewith. The aforementioned arm means preferably comprises a pair of spacedly disposed arms having the roll disposed therebetween and each supporting therefrom a chuck for engaging with respective ends of the roll core. Because the two arms act symmetrically and hold the roll in perfect center, no special hardware is needed to maintain proper alignment.

In accordance with the present invention there is preferably also provided a carriage that is disposed for translation in the frame. The carriage is supported in the frame in a manner to permit vertical movement of the carriage to raise and lower the web material roll. For this purpose, a jack means is provided for operating the carriage to raise the web material roll and associated therewith is a release means for operating the carriage to lower the web material roll. The jack means in the disclosed embodiment is foot operated and includes a foot actuating pedal. Alternatively, the carriage may be operated electro-hydraulically or by means of an electrically powered screw jack. Means are also provided supported in the carriage for moving the arms horizontally toward and away from each other to respectively engage and disengage the web material roll. This means for moving the arms comprises a lead screw means that moves the arms equally and in unison. The lead screw means in the disclosed embodiment is controlled by a crank handle.

The apparatus of the present invention further comprises drive means for engaging the outer periphery of the roll to drive the roll. Means are provided for supporting the drive means from the frame. The drive means preferably comprises roll drive belts that have direct surface contact with the webbed material roll. The drive means also includes a drive motor the speed of rotation of which is controlled from a control means. The control means senses the draw rate of the web material into the utilization machine to in turn control the rate of drive of the drive means or, in particular the drive motor. In other words, if the utilization machine speeds up then this is sensed by the control means and the drive means also :speeds up to feed the web material from the roll at a speed corresponding to the speed that the material is drawn into the utilization machine. The means for supporting the drive means preferably comprises an elongated arm-like support member that is pivotally connected at one end to the frame at a pivot point located at a height near the top of the full web material roll. In the disclosed embodiment the pivot point is located at a height over the top of a full web material roll. Weight means are preferably provided on the elongated support member at the free end thereof so that good intimate contact is provided between the roll belt drive and the outer surface of the roll.

One of the features of the present invention relates to the manner in which the drive means is supported. This is supported in a manner so that maximum force is imposed by the drive belts on the roll when the roll is full and the force decreases as the diameter of the roll decreases. This arrangement provides for a more uniform drive without causing creasing or bunching or the aforementioned "telescoping" of the roll. This variation in contact force with the roll comes about by the movement of the drive support structure from a more horizontal position toward a vertical position in which the vertical force component varies as the angle of the drive support member changes, as the diameter of the roll in turn changes.

The apparatus of the present invention furthermore includes roller means for receiving the web material from the roll and for support and guiding of the web material between the roll and the utilization machine. The roller means is also supported from the frame. The roller means preferably comprises a plurality of rollers and means supporting the rollers from a very top part of the frame. The rollers are supported at the top of the frame to form a web material loop between them and the utilization machine. In an alternate embodiment of the present invention there may be provided a separate web support means disposed away from the frame to alternatively provide a web material loop. It is the position of this loop that is sensed to determine the speed control. In an alternate preferred arrangement the separate support means may be secured to the utilization machine and may be supported on a pedestal from the utilization machine.

The aforementioned control means of the present invention includes means for sensing the depth of the web material loop to, in turn, control the drive means to maintain a substantially constant web material depth. This means for sensing may be comprised of an ultrasonic detector positioned under the web material loop. A support bar may be used for supporting the ultrasonic detector and is pivotally connected to the frame. The control means includes control circuitry for sensing the delay period of ultrasonic signals from the ultra sonic detector to provide an analog control signal for the roll drive means.

In association with the roll drive means there is also preferably provided a torque means engaging the web material between the roll and the utilization machine and used for the purpose of tensioning of the web material between the rollers and the roll itself. The torque means may be comprised of a torque motor, associated web material support roller, and trolley roller means to maintain the web in constant contact with the torque roller. This arrangement provides a small and controlled amount of tension in the web as it is driven from the roll and drawn into the utilization machine. The torque support roller provides for guidance of the web and moreover provides the small drive force desired to carry the web from the roll to the gravity loop.

Associated with the apparatus of the present invention are a number of sensors. There is one sensor disposed adjacent the web material roll for detecting an end of roll condition. There is another sensor disposed adjacent the web material between the roll and the utilization machine to detect a break in the web material. There is also provided a sensor disposed adjacent the web material between the roll and the utilization machine to sense a mill splice in the web material.

BRIEF DESCRIPTION OF THE DRAWINGS

There is additionally provided a chuck adaptable to varying diameter roll cores. The chuck may include either externally expanding support projections that accommodate varying diameters or, alternatively, the chuck may include a group of axially extended concentric tears of decreasing diameter from the support arm. Both types of chucks may include means for positively gripping the roll core interior and may be adaptable for attachment to a driving motor.

Numerous other object, features, and advantages should now become apparent upon a reading of the following detail description taken in conjunction with the accompanying drawings in which:

FIG. 9 is a fragmentary cross-sectional view taken along line 9—9 of FIG. 7 showing further details of the torque mechanism of the invention;

FIG. 10 is a fragmentary cross-sectional view taken along line 10—10 of FIG. 7 showing further details of the mill splice detector;

FIG. 11 is a side elevation view of an alternate embodiment of the invention employing an extra support means in the form of a shoe for forming the web material sensing loop;

FIG. 12 is a cross-sectional view taken along line 12—12 of FIG. 11;

DETAILED DESCRIPTION OF THE PREFERRED EMBODIMENTS

There is now described herein a substantially improved roll feeding machine that is adapted to handle rolls of web material as might be fed into, for example, a laser printer. In accordance with the present invention one of the substantial improvements herein relates to the use of support arms carrying respective chucks that automatically follow the arms and insert themselves into the roll core. This arrangement eliminates the need for core shafts as have been employed in prior art machines. Also, in accordance with the present invention, there is a much improved control technique for speed matching with the web utilization machine. The position of a gravity held loop of web material is detected for controlling the drive means for the web material roll. It is preferred in accordance with the present invention to drive the roll by a surface driven belt means in which the weight imposed by the drive and belt means varies so that less weight is impressed upon the roll as the diameter of the roll decreases. This arrangement prevents the common "telescoping" problem of the prior art.

Also, in accordance with the present invention the use of the machine is substantially simplified. There are fewer rollers that are employed. The machine of the present invention is also relatively light in weight and is very easily moved about.

The gravity held paper control loop of the machine of the present invention provides many benefits. It places no tension spikes on the machine it is feeding. When tension is required there is provided a torque motor which allows one to dial in an infinitely adjustable torque which is smooth and constant. The machine of the present invention requires no tram or alignment to the machine it is feeding. The machine of the present invention provides no marks or creases on the web material that is being fed.

Figure 1:
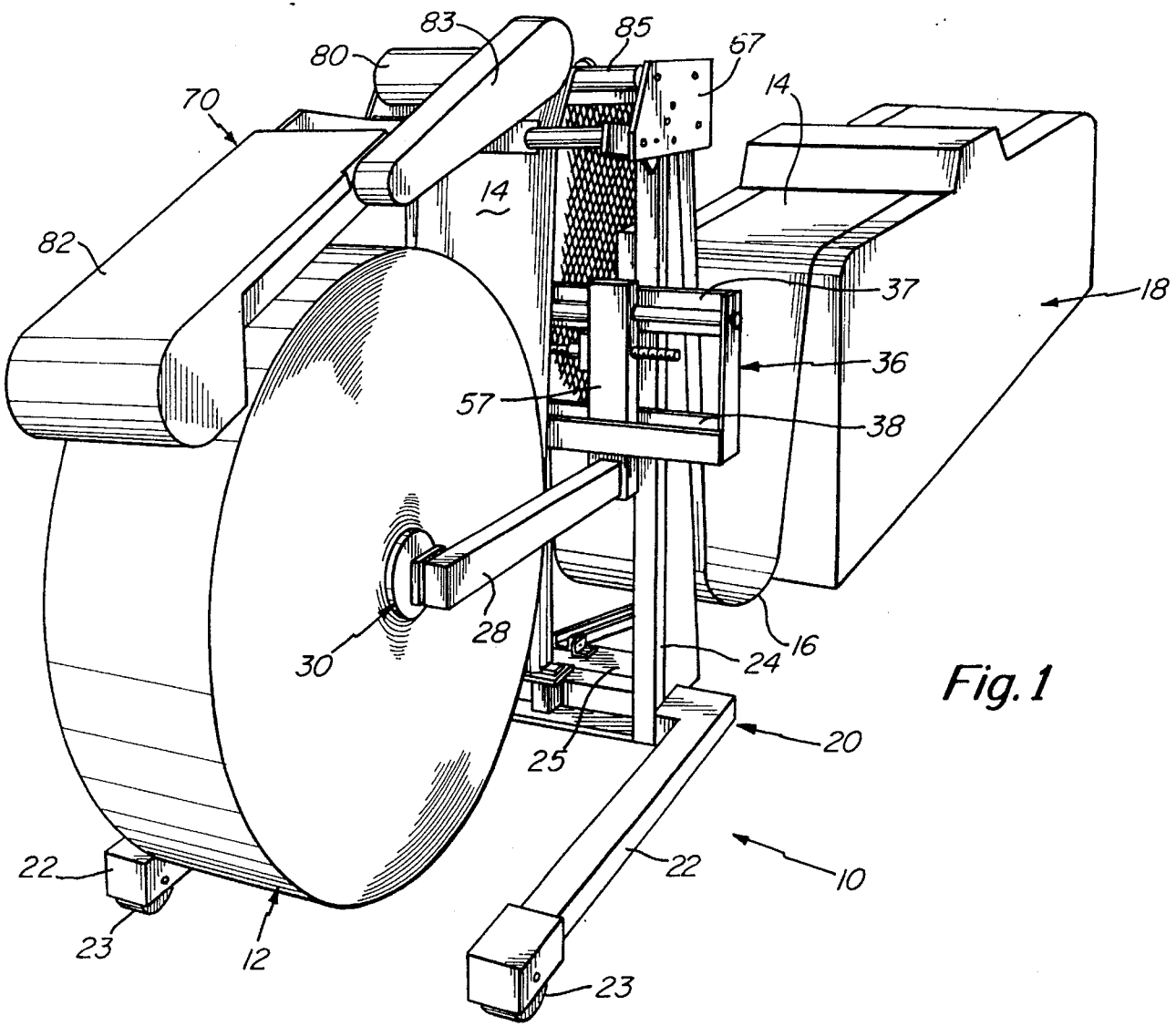
FIG. 1 is a perspective view of a roll feed machine constructed in accordance with the principals of the present invention.

Referring now more particularly to the drawings, there is shown a roll feeding machine 10 that is illustrated in FIG. 1 having supported therein a large roll 12 that may be a roll of paper this roll of paper may be comprised of several continuous forms separated by perforations. FIG. 1 illustrates the web material 14 from the roll being formed into a loop 16 and being drawn into a utilization machine such as the one illustrated in FIG. 1 by the machine 18. The machine 18 may, for example, be a printer, burster, collator, inserter or a combination machine. Depending upon the type of utilization machine 18, the feed can be relatively constant or the feed can occur in a somewhat variable fashion. The roll feeding machine of the present invention is adapted to accommodate virtually any type of machine that it is to be utilized therewith.

The roll feeding machine 10 is comprised of a frame 20 having base legs 22 and a pair of upright members 24. The base legs 22 carry support wheels 23. Two of these wheels 23 are at the very ends of the base legs 22 and another pair of the wheels 23 is disposed in the frame section 25 bridging between the upright members 24.

Figure 5:
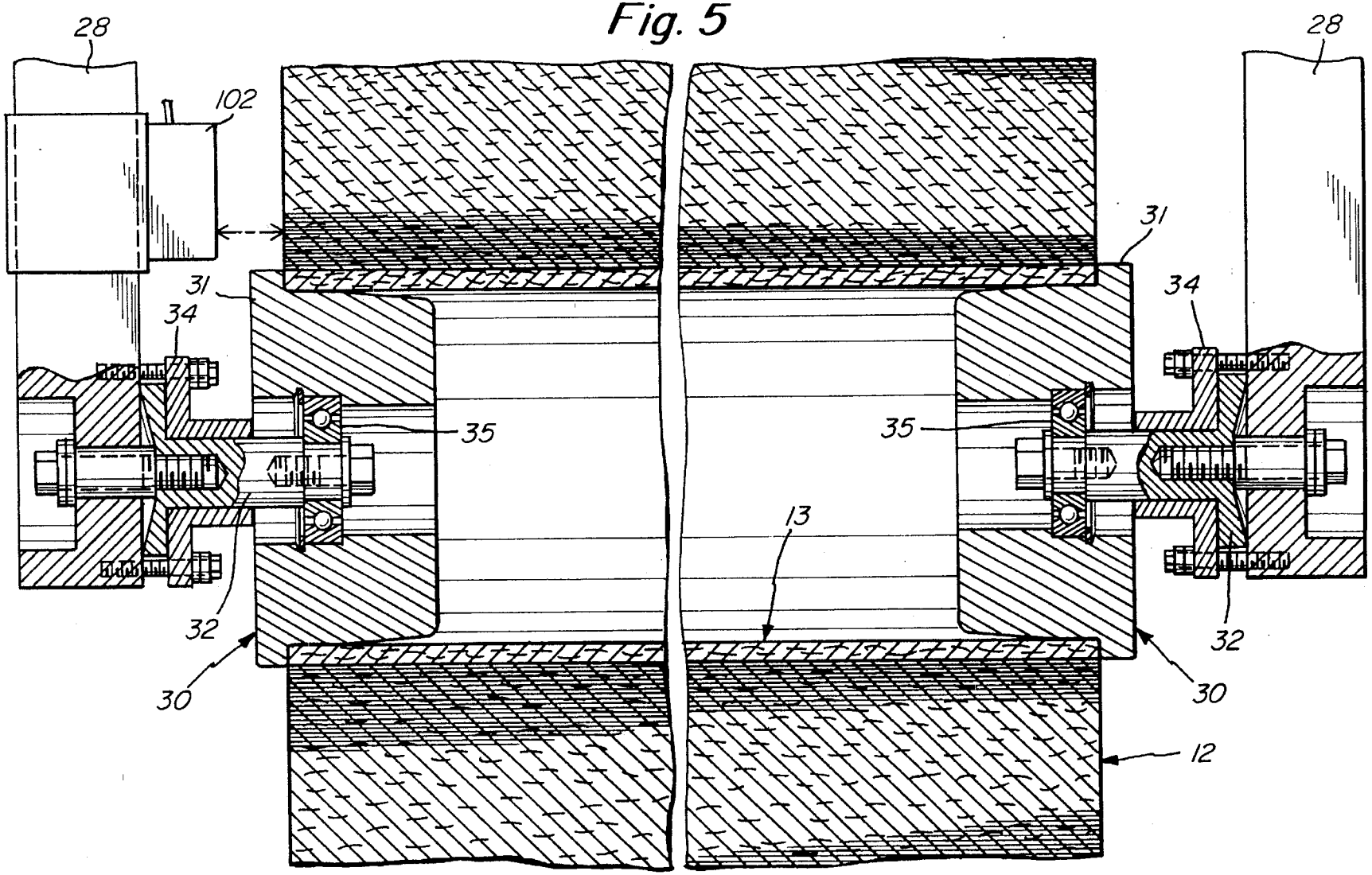
FIG. 5 is a fragmentary cross-sectional view taken along line 5—5 showing further details of the support structure for the improved support of the roll in accordance with the present invention.

The web material roll 12 is supported by a pair of support arms 28. Each supporting at the respective free ends thereof a chuck 30. The details of the chuck construction are illustrated in FIG. 5. The chucks 30 are adapted to move into the core of the roll 12. In this regard in FIG. 5 note the cardboard core 13. FIG. 5 illustrates the chucks 30 having been moved into intimate contact with the ends of the core 13. Each of the chuck mechanisms includes a chuck body 31, a support member 32, and flange 34. A bearing 35 is used for the support of the body 31 with the support member 32. It is noted that each of the chuck bodies 31 is tapered so as to easily accommodate the roll core 13.

The support arms 28 as well as the chucks 30 are positioned upon manufacture of the machine in relationship to the rest of the frame, and in particular with relationship to all of the support rollers held in the frame, so that once a roll is grasped by the arms the feed is always in alignment.

The roll support arms 28 are carried by a carriage 36 that is comprised of cross pieces 37 and 38 secured to upright pieces 39 and 40. With regard to this construction refer in particular to FIG. 1 and 6.

Figure 6:
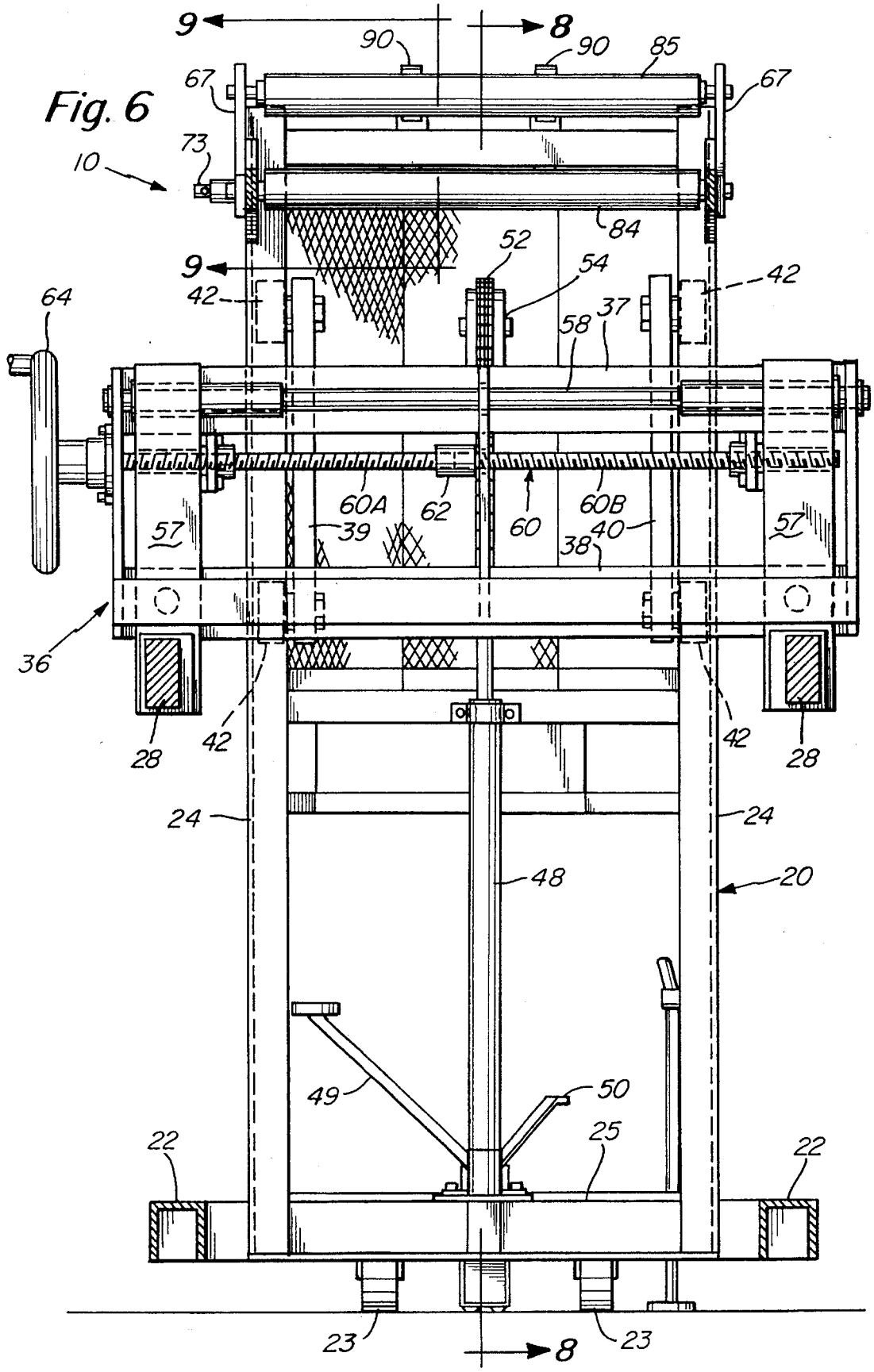
FIG. 6 is a cross-sectional view taken along line 6—6 of FIG. 2.

The upright pieces 39 and 40 carry a guide rollers 42 as illustrated in FIG. 6. These guide rollers are adapted to move in the U-shaped upright members 24. The guide rollers 42 guide the carriage as it moves up and down in the frame. In this connection the upper limit of the carriage is controlled by the carriage stop 45 such as is illustrated in FIG. 8.

The carriage 36 is moved up and down by means of a hydraulic jack arrangement. This is illustrated in, for example, FIG. 6 and 8 by the hydraulic mechanism 48 which is operated from the foot lever 49 and released from the release lever 50. The levers 49 and 50 are illustrated in FIG. 6.

Figure 8:
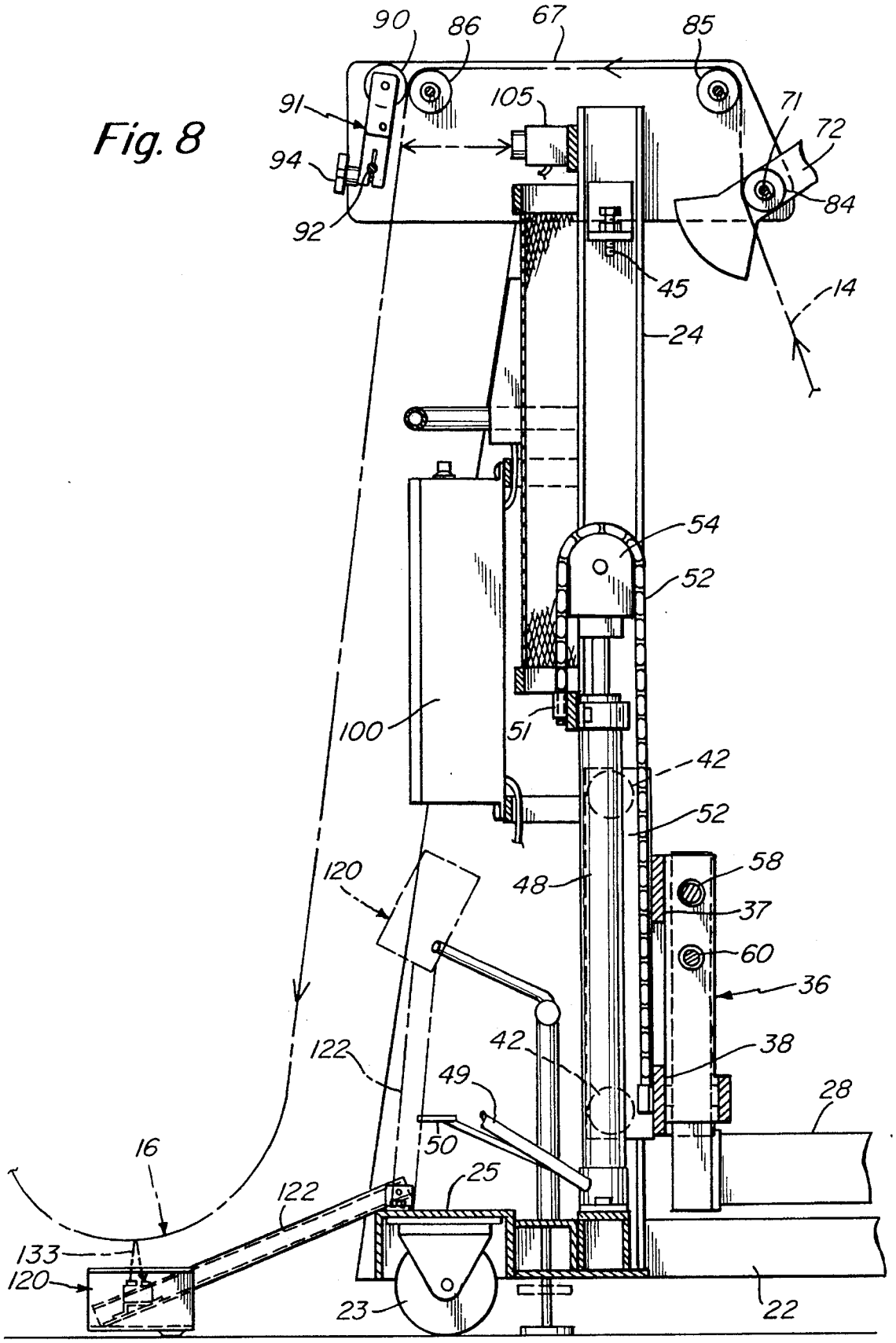
FIG. 8 is a cross-sectional view taken along line 8—8 of FIG. 6 showing in particular further details of the jack mechanism for raising and lowering the frame carriage.

For the purpose of lifting the carriage 36, there is provided a drive chain 52 illustrated in FIG. 8. The chain 52 couples from the hydraulic mechanism to the carriage at the cross piece 38. The chain 52 is maintained stationery at its fixed end 51 and the carriage 36 is caused to move by virtue of support member 54 being moved upwardly by operation of the hydraulic mechanism 48. When the foot pedal is operated, the lever 49 moves downwardly and operates the hydraulic mechanism 48 to cause the support member 54 to move upwardly engaging the chain 52 and causing the unfixed end of the chain at 38 to move upwardly. As viewed in FIG. 8, when the pedal is pumped, the carriage 36 is successively moved upwardly by incremental motion of the support member 54 upwardly. The relief lever 50 releases the hydraulic pressure in a gradual manner to cause the carriage to move downwardly essentially with the force of gravity until the carriage bottoms out at its lower most position as is substantially illustrated in the fragmentary cross-sectional view of FIG. 8.

As indicated previously, the carriage 36 carries the roll support arms 28. The arms 28 are respectively supported from respective support members 57. In this regard refer to FIG. 6. The members 57 are supported by the carriage and are adapted to move toward and away from each other. The members 57 are guided by a guide rod 58. In this regard, in FIG. 1 the members 57 are shown in their more inward position with their arms 28 engaging the roll 12. Alternatively, in FIG. 6 the arms 28 have been opened and thus it is noted that the support members are shown at the outer ends of the carriage 36.

The support members 57 with their associated arms 28 are caused to be moved in the carriage by means of a lead screw arrangement that is comprised of a lead screw 60 including separate opposite hand lead screw pieces 60A and 60B. These lead screw pieces are secured at the middle, as illustrated in FIG. 6 by the block 62. FIG. 6 also illustrates the circular handle 64 that is used to operate the lead screw 60. The lead screw 60 passes through each of the support members 57. When the handle 64 is rotated in either direction the lead screw pieces 60A and 60B rotate and carry with them the support members 57. The direction of turns of the lead screw pieces 60A and 60B are arranged so that one is a right hand and the other a left hand screw so that as the actuating handle 64 is turned, the members 57 move toward each other or away from each other depending upon the direction of rotation of the circular handle 64. This arrangement enables one to move the arms away from each other to cause the respective chucks to disengage with a roll, and alternatively to permit the chucks to move toward to engage with a roll. All of this operation takes place by means of a lead screw arrangement by rotation of the handle 64 in the desired rotational direction.

Figure 2:
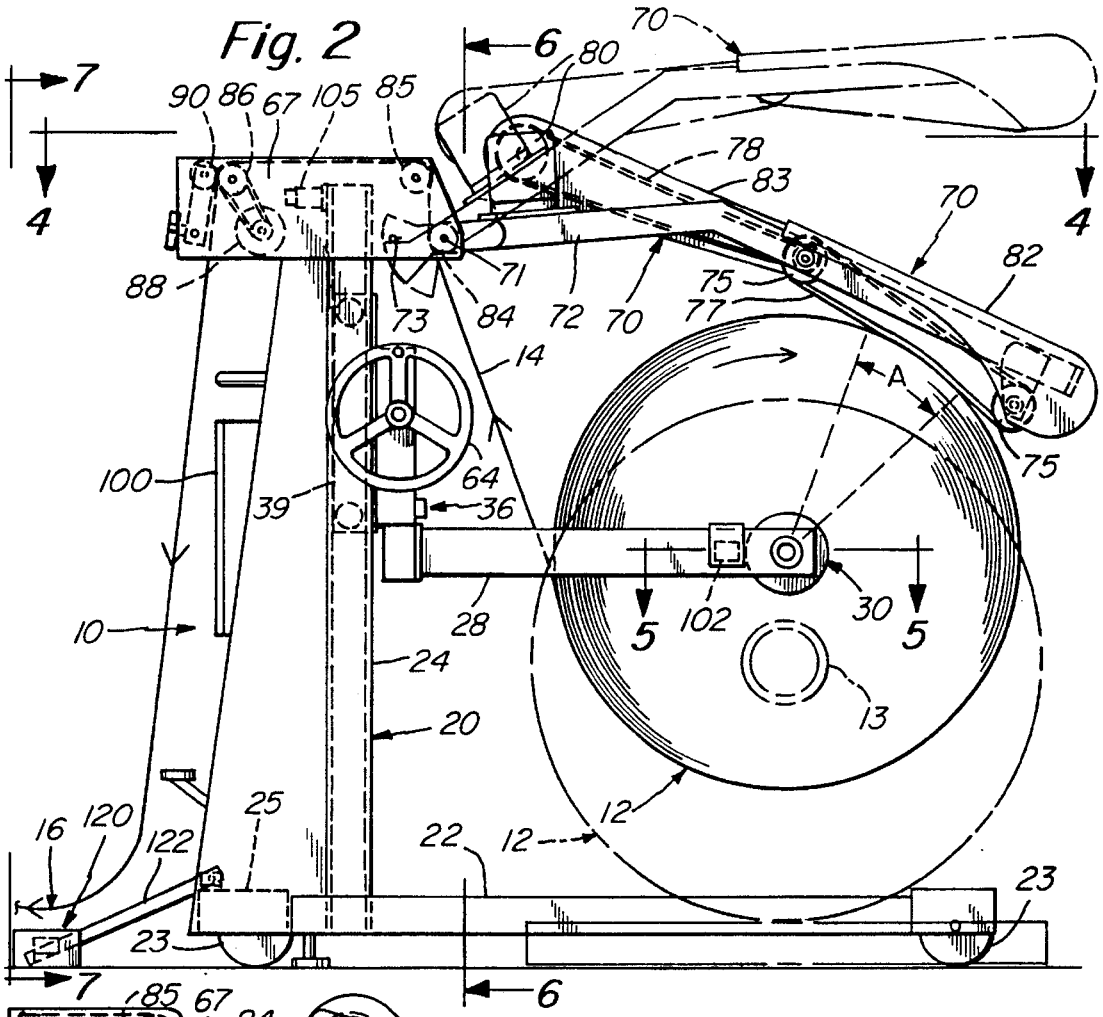
FIG. 2 is a side elevation view of the machine of FIG. 1 illustrating the drive means for the roll in engagement therewith in full outline and furthermore indicating the same drive means in phantom outline in its upper locked position.
Figure 3:
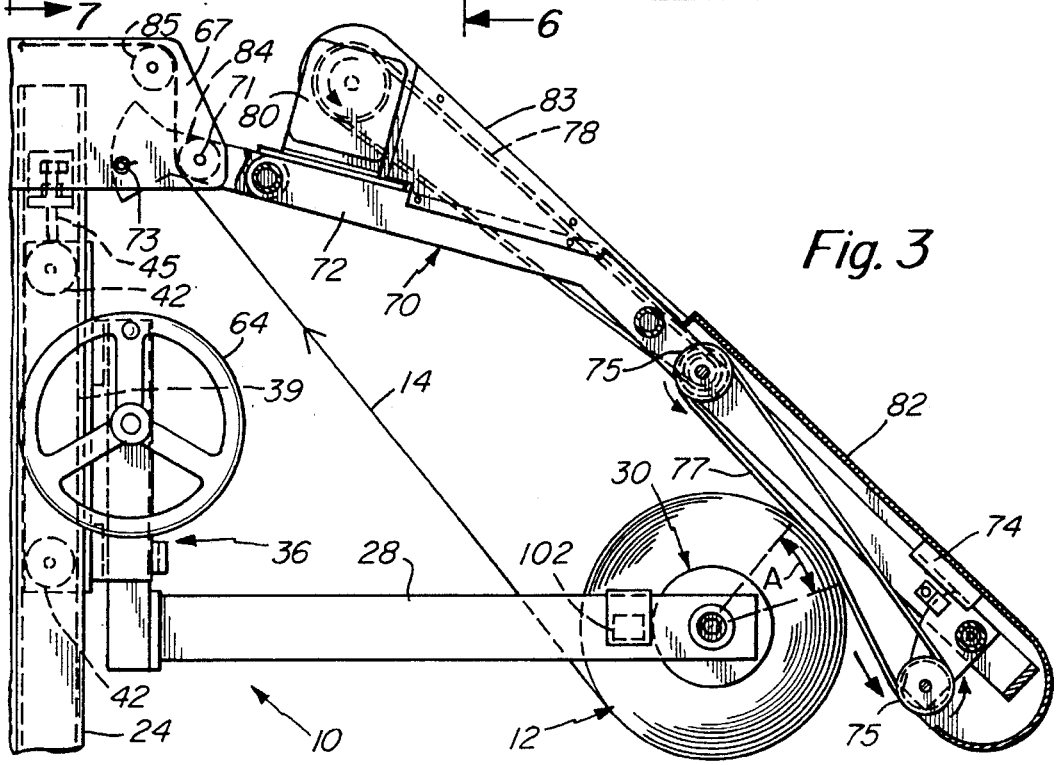
FIG. 3 is a fragmentary side elevation view showing the position of the drive means for the roll when a majority of the roll has been used unwound illustrating the change in position of the drive structure.

The very top of the upright member 24 support respective plates 67 that are used to support the rollers, to be described hereinafter. Also supported from the plates 67 is the drive means of the present machine. This drive means, as illustrated, for example, in FIGS. 1–3, is comprised of a elongated support member 70 that is an angled member as illustrated in FIGS. 2 and 3. The elongated member 70 is pivoted at one end at the pivot point 71. In FIG. 2 the elongated support member 70 is illustrated in solid outline in a position in which the drive means is engaging the roll and is also illustrated in phantom outline in a position in which the elongated support member 70 is disposed out of the way lifted upwardly and locked in that position by means of the engagement of the arm with a locking pin 73 as illustrated in FIG. 2.

The pin 73 may be one that is readily disengaged by hand to enable one to unlock that position and move the elongated support member downwardly into an engagement with the roll.

The elongated support member 70 supports a number of rollers. In this regard refer to FIG. 3 and 4. These rollers 75 support a pair of drive belts 77 disposed in the manner illustrated in FIG. 4 spaced apart. Also refer to FIGS. 2 and 3 for an illustration of the drive belts 77 tangentially engaging the roll 12.

As noted in FIGS. 2 and 3, the belts 77 are preferably not taut between the support rollers but instead have a slight looseness that permits the belts to wrap about a substantial portion of the roll as indicated in FIGS. 2 and 3. The drawings illustrate by the angle A the approximate surface contact area of the belts with the roll. The angle A is preferably greater than 10° and may be in the range of 10°–30° of arc providing a substantial contact of the drive belt with the roll.

Figure 4:
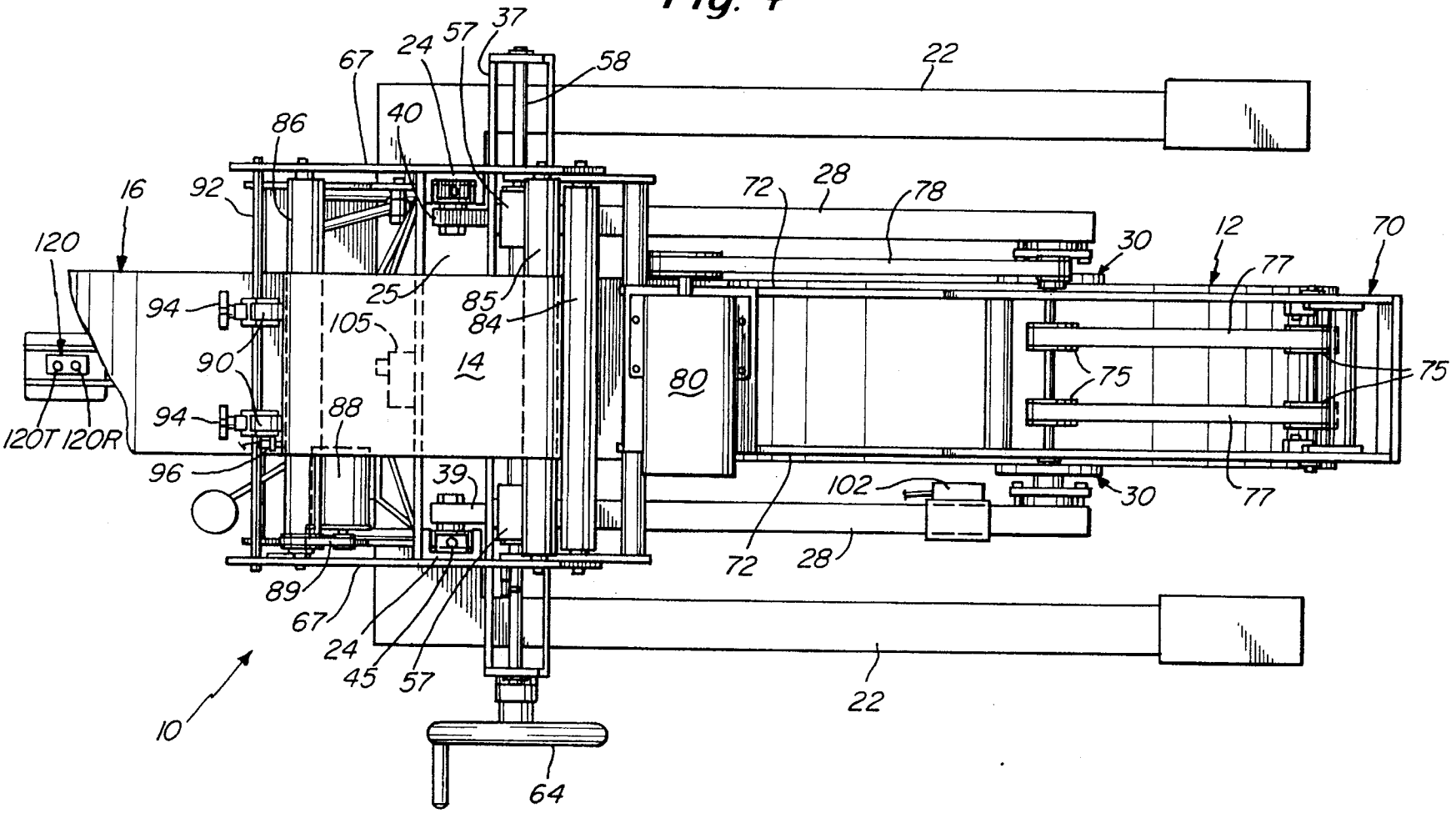
FIG. 4 is a plan view substantially as taken along line 4—4 of FIG. 2.

In addition to the belts 77, there is also provided one additional drive belt 78 shown in FIG. 4 that is driven from the drive motor 80. The drive motor 80 is also supported from the elongated member 70 such as illustrated in FIG. 3.

Associated with the drive mechanism for the roll are a pair of protective hoods. These are illustrated in, for example, FIGS. 1–3. This includes a hood 82 that is disposed over the belts 77 as well as a hood 83 that is disposed to primarily cover the belt 78.

One of the features of the present invention is the use of weights at or near the end of the elongated support member 70. These are illustrated in, for example, FIG. 3 by the weights 74. These weights provide additional force for the entire drive assembly so that the belts 77 have intimate contact with the periphery of the roll 12. In this connection it is noted that the arrows in FIG. 3 illustrate the direction of rotation of belts 77. FIG. 2 illustrates by arrow the direction of rotation of the roll 12.

The drive mechanism for the roll including the elongated support member 70 is intentionally arranged so that the the pivot point 71 is disposed at a location on the frame that is a relatively high location on the frame above the top of even a full roll that is being unwound. Such a substantially full roll is illustrated in FIG. 2. It is noted that in this position the elongated support member 70 is close to a horizontal position and as a matter of fact one of the arms 72 thereof is substantially horizontal. This provides a maximum force component from the overall weight of the assembly and the added weights 74. This maximum force is imposed only when unrolling the maximum diameter. As the roll becomes unwound, the entire driving assembly pivots downwardly such as to the position of FIG. 3. It is noted that in that position the drive assembly has moved closer to a vertical position and thus a force imposed by the belts 77 upon the roll is less than in the position of FIG. 1. This is desired because as the diameter of the roll decreases proper operation occurs when the force on the roll is less. This helps to prevent "telescoping" of the material as it is unwound from the roll.

Reference is now made to the plurality of rollers disposed between the plates 67 and supported therebetween. These rollers are depicted, for example, in FIGS. 2–4 and 8. The web of material on the roll passes over these rollers and forms the aforementioned loop 16. In this regard refer, for example, to FIG. 8 that shown the loop 16 as well as the web 14 passing over rollers 84, 85 and 86 in succession. The rollers 84 and 85 are free rotating rollers while the roller 86 is a torque roller. In this regard, refer to FIGS. 4 and 9 for an illustration of the torque motor 88 which is mounted from the frame and, in particular, from one of the plates 67. The torque motor 88 has associated therewith a drive belt 89 that drives the torque roller 86. The direction of drive is in the direction of movement of the web 14, imposing a tension in the web as the roll is rotated by The drive means. The torque roller 86 in essence takes up any slack and maintains a constant tension on the web 14 in the web area between the roller 86 and the roll 12.

Associated with the torque or idler roller 86 are a pair of trolley rollers 90. The trolley rollers 90 are supported from a hinged member 91 shown in detail in FIG. 9. The member 91 is spring biased to provide a force through the trolley roller 90 on the web. The support member 91 is supported on a shaft 92 as illustrated in FIGS. 4 and 9. The securing knobs 94 provide for adjustment for the member 91 on the shaft 92 so it should be able to provide different degrees of pressure of the trolley roller against the idler roller 86.

Figure 9A:
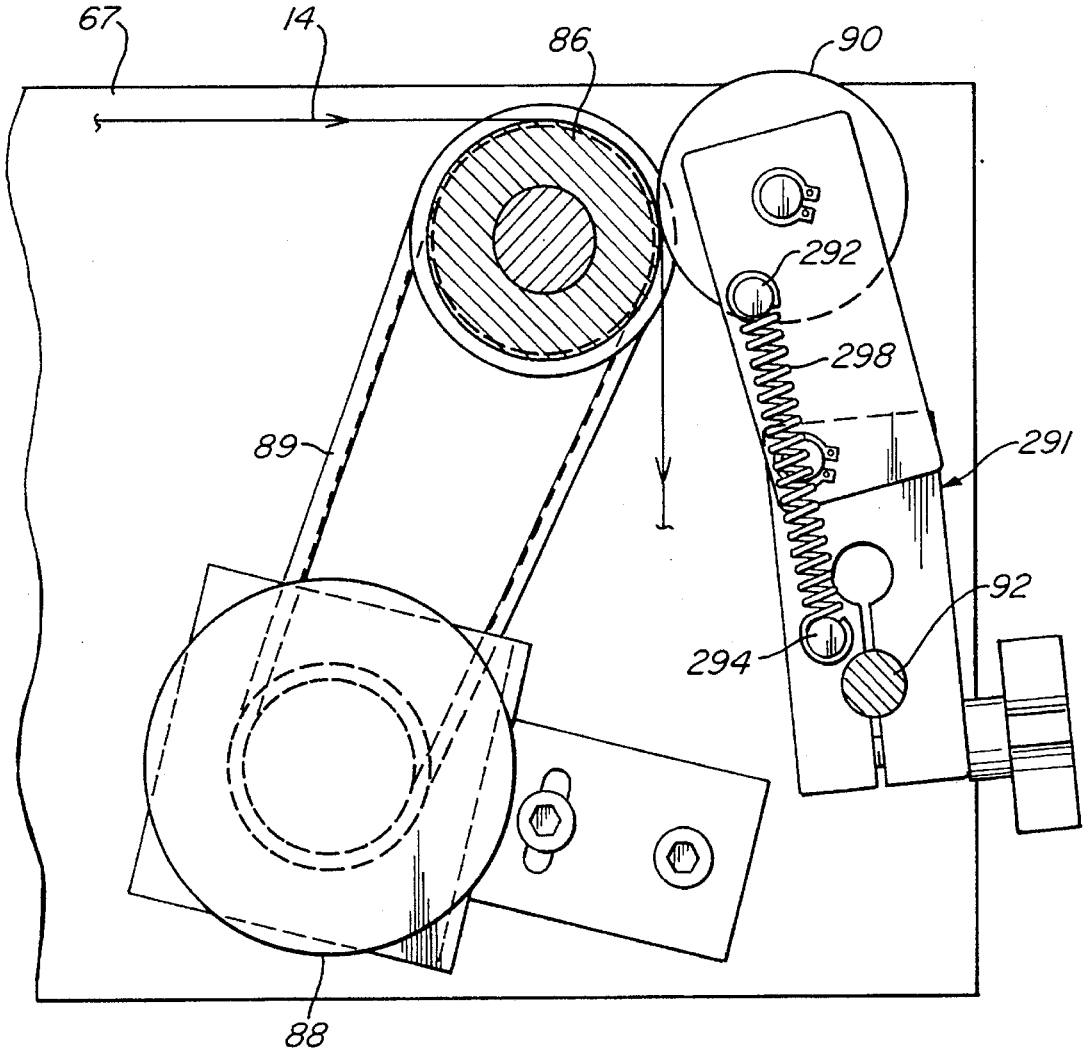
FIG. 9A is a cross-sectional view of an alternative embodiment of a trolley roller for the torque mechanism of FIG. 9.

A second embodiment of a trolley roller 90 assembly is depicted in FIG. 9A. The hinged member 291 includes a pair of pins 292, 294 mounted upon opposing sides of the member 291. Upon the pins is positioned a tension spring 298 that maintains the trolley roller in pressurized contact with the web 14. The tension spring may prove more reliable over long term use. However either the compression spring 98 embodiment of FIG. 9 or this tension spring 298 embodiment may be used interchangably in this description according to this invention.

Figure 7:
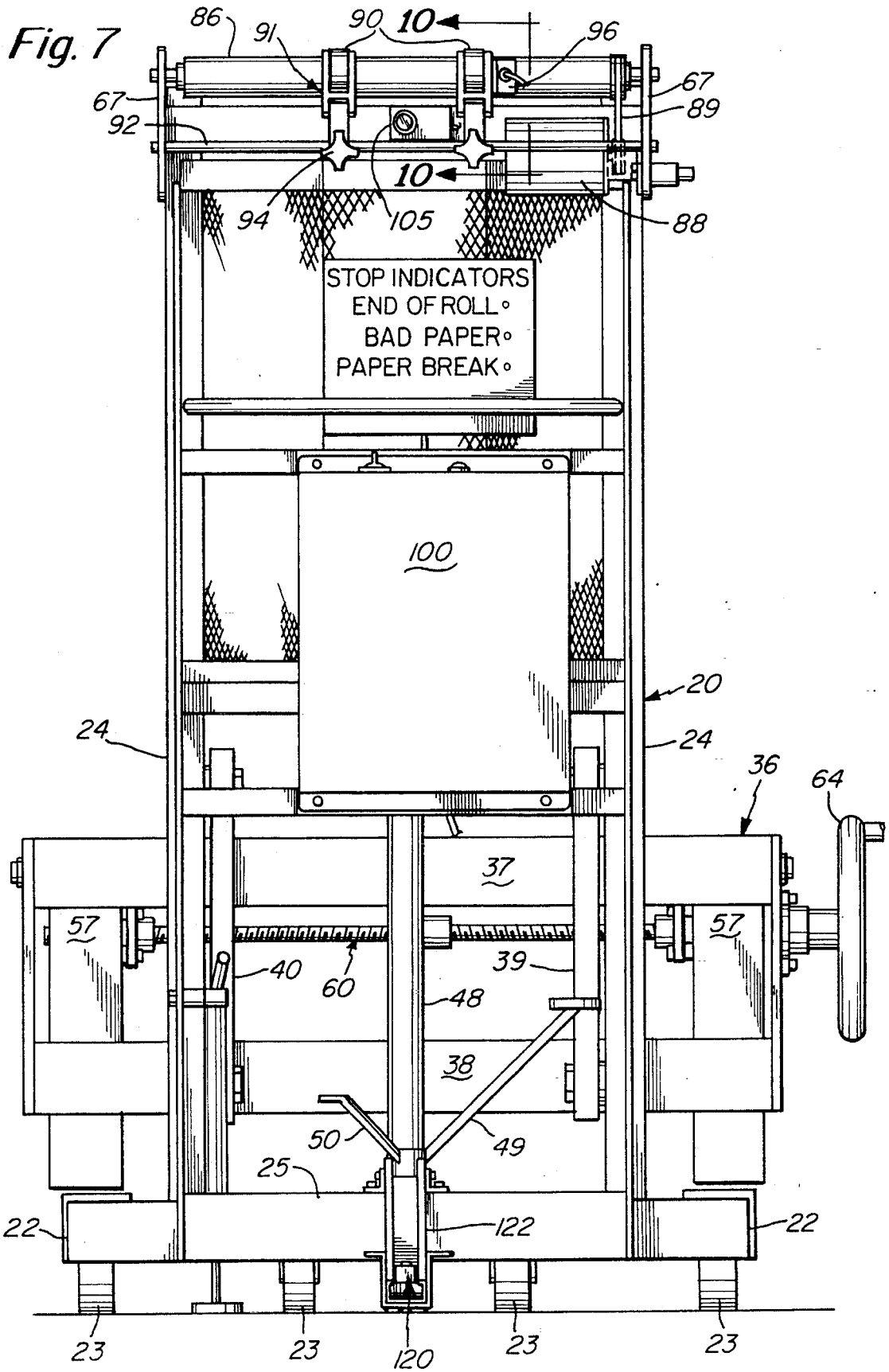
FIG. 7 is a cross-sectional view taken along line 7—7 of FIG. 2.

Reference is now made to the fragmentary view of FIG. 10. FIG. 10 also shows the torque or idler roller 86 and one of the trolley rollers 90. FIG. 10 furthermore illustrates the mill splice detector 96 which is adapted to detect a splice in the web such as is illustrated at 97 in FIG. 10. FIG. 10 also illustrates the spring 98 that is used to urge the trolley roller against the idler roller. As the trolley roller rocks back due to the extra thickness at the splice, the proximity sensor 96 senses this distance from the idler roller and provides an appropriate signal to the control electronics. In this regard refer to the control box 100 illustrated in FIG. 7 and 8.

Thus, the trolley roller rides on the exit idler roller at all times. The web material passes under the trolley roller. The proximity sensor 96 is mounted on the trolley roller frame and measures the distance from the sensor tip to the surface of the idler roller. This measurement is made electromagnetically. When a splice, hole or wrinkle passes under the trolley roller the sensor is raised providing an increase in the sensed distance. This signal is AC coupled to sensor logic to provide a signal for stopping the utilization machine.

There are other sensors that are also associated with the apparatus of the present invention. One of these is an end of roll sensor illustrated in FIGS. 2 and 5 as the sensor 102. The sensor 102 is supported from one of the arms 28 and maybe adjustable along the arm so as to sense the end of the roll at different locations in the diameter of the roll. The sensor 102 is preferably an optical sensor. The sensor projects light and detects the reflection from the edge of the roll. When the roll is consumed to a radius smaller than the sensor location, then the reflected light signal is lost and the sensor then sends a signal to control logic to indicate that the end of the roll has been reached. This signal can then interrupt the operation of the utilization machine.

A further detector that is employed is one that detects a web break. This is illustrated in, for example, FIGS. 2, 4 and 8 as the detector 105. This detector is a reflective optical sensor that illuminates the span of web at a position adjacent the torque roller 86. In the event of a break in the web the torque roller 86 draws all of the web below the break out into the loop. Once the web leaves the roller 86 then the detector 105 detects this signal indicating a web break. This signal is also sent to the control electronics and may be used to interrupt to utilization machine. The web break detector immediately detects any break in the web and can shut the entire system operation down to prevent excess web material from simply falling continuously onto the floor. As indicated previously, when used within a utilization machine 18 as illustrated in FIG. 1, the web material is formed into a loop 16. It is the position of the loop 16 that is detected to control the operation of the drive motor 80 which in turn controls the speed of drive of the roll 12. For this purpose there is provided an ultrasonic detector 120 illustrated, for example, in FIGS. 2 and 8. The detector 120 is preferably pivotally supported from bar 122 which in turn is secured to the frame as illustrated in the drawings. The bar 122 may be pivoted out of the way when the machine is to be moved. FIG. 8 illustrates the ultrasonic detector 120 in its operative position. The ultrasonic detector 120 is comprised of a transmitter 120T and a receiver 120R. In this regard refer to FIG. 4 and also to the schematic block diagram of FIG. 15.

In the alternate embodiment of FIG. 11, an additional member is provided to form the loop 16 because the utilization device which is a laser printer 111 has its feed from the bottom. There is thus provided a pair of support bars 110 that support an auxiliary support member such as the shoe 112 depicted. The shoe 112 may have associated therewith a tensioning brush 114 and associated guides 116. This arrangement provides a certain tension between the shoe 112 and the laser printer 111. Such an arrangement is used when the utilization device typically feeds the roller material into the bottom end thereof. In that instance the auxiliary support means is used for the purpose of forming the detection loop 16.

Figure 15:
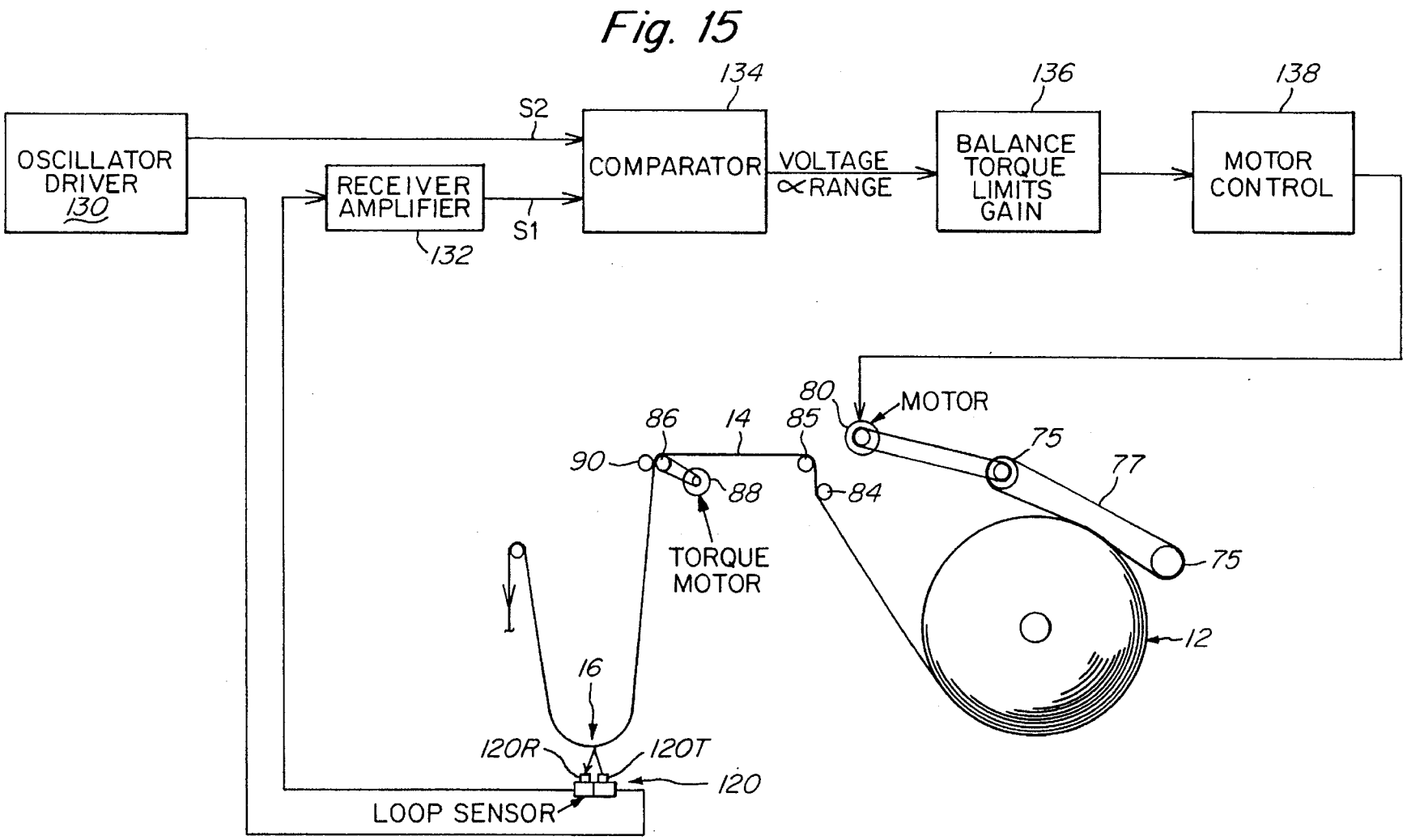
FIG. 15 is a schematic block diagram illustrating the control means in accordance with the present invention.

Reference is now made to the block diagram of FIG. 15 for a further explanation of the detection of the position of the loop 16 as it relates to the control of the drive motor 80. FIG. 15 shows an oscillator driver 130 that couples to the transmitter 120T. The receiver 120R couples by way of the receiver amplifier 132 to a comparator 134. The comparator also receives a signal directly from the oscillator driver 130. Thus, the comparator 134 receives two signals that are displaced in time by an amount that is a function of the transit time from the transmitter, to the surface of the loop 16 and back to the receiver. In this regard, note the path indicated in dotted outline at 133 in FIG. 8. If the loop 16 is at a low position such as is illustrated in FIG. 8 then this occurs because the roll is being driven too fast in comparison to the drawing in by the utilization machine. In this instance, the delay period is at a minimum and this minimum delay is used as a voltage at the comparator 134 to drive the motor 80 at a lower speed. The lower speed of operation in comparison to the feed into the utilization machine then moves the loop upwardly until an equilibrium is established when the loop 16 is some predetermined distance away from the ultrasonic detector 120.

On the other hand, if the utilization machine speeds up then the loop 16 raises and the delay period indicated at 133 in FIG. 8 increases. This provides a larger voltage at the output comparator 134 coupled to the motor 80 to cause the motor speed to increase. The motor speed then increases into an equilibrium state with the drawing in speed of the utilization machine.

Now, in FIG. 15 between comparator 134 and the motor 80 there are shown standard blocks including a device 136 that balances the torque and limits the gain of the system. The output device 136 couples to a motor control 138 which drives the motor 80. The control 136 and 138 are considered to be of conventional design.

The speed control that senses the loop 16 operates the same in the embodiments of FIGS. 1–10 as in the embodiment of FIG. 11. In this regard in FIG. 11 note the use of the ultrasonic detector 120 on its pivotal support bar 122. The ultrasonic detector 120 in FIG. 11 also detects the position of the loop 16 as far as its distance from the detector 120 is concerned.

Figure 13:
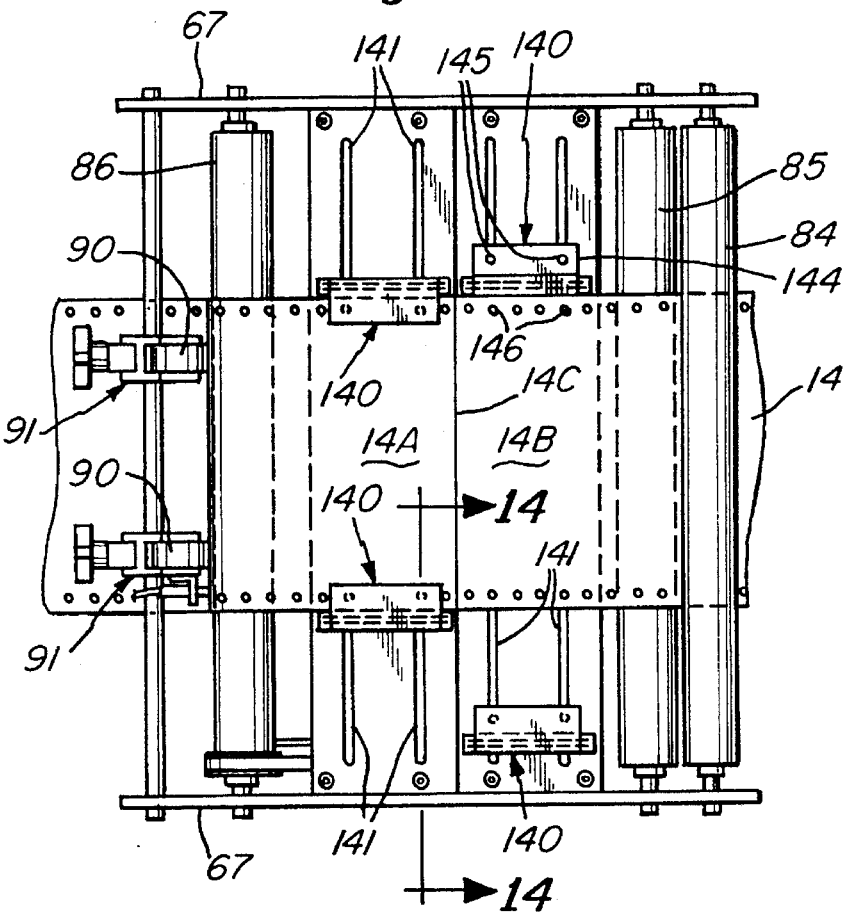
FIG. 13 is a partial top plan view of an alternate embodiment of the invention employing a web splicing attachment.
Figure 14:
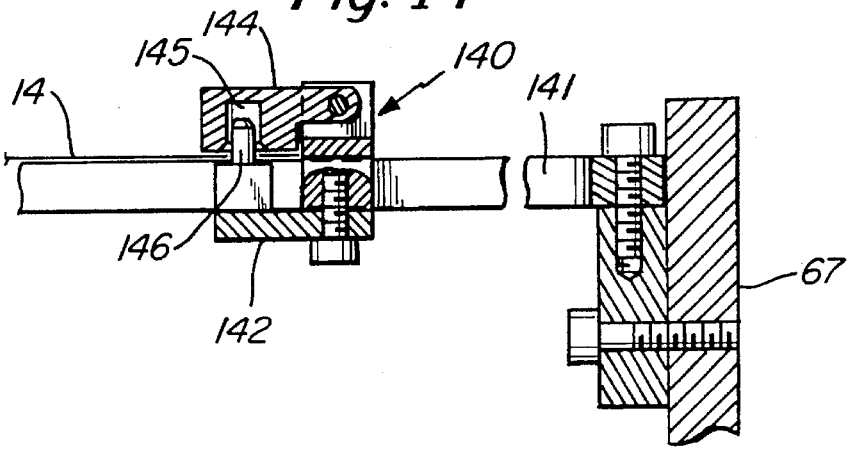
FIG. 14 is a cross-sectional view taken along line 14—14 of FIG. 13.

FIGS. 13 and 14 illustrate a further alternate construction in accordance with the invention. There is described therein a splice attachment that may be employed at the very top of the frame supported between the plates 67. This splice attachment is supported between the rollers 85 and 86 as illustrated. It is comprises of four laterally displaceable splicing members 140. One of these menders is shown in a cross-sectional view in FIG. 14. Each of the members may slide in a slot 141 to a position against the web 14. The member 140 is comprised of a base 142 in a hinged top piece 144 having a hole 145 for receiving the pin 146 extending from the base 142. The side slots in the paper are received by the pin. The member 140 is positioned to align two separate web segments 14A and 14B at a splice line 14C. The members 140 are moved into position and engage with the different pieces of the web material. A special purpose tape may then be used along the joint 14C to seal the two web sections 14A and 14B together.

There has been described herein an arrangement in which an ultrasonic detector is mounted under the loop 16. In an alternate embodiment of the invention the detector may also be mounted above the loop 16 or essentially inside of the loop. The arrangement illustrated is preferred. Also, the ultrasonic detector may be replaced by an optical detector preferably positioned below the loop and possibly positioned above the loop.

Figure 16:
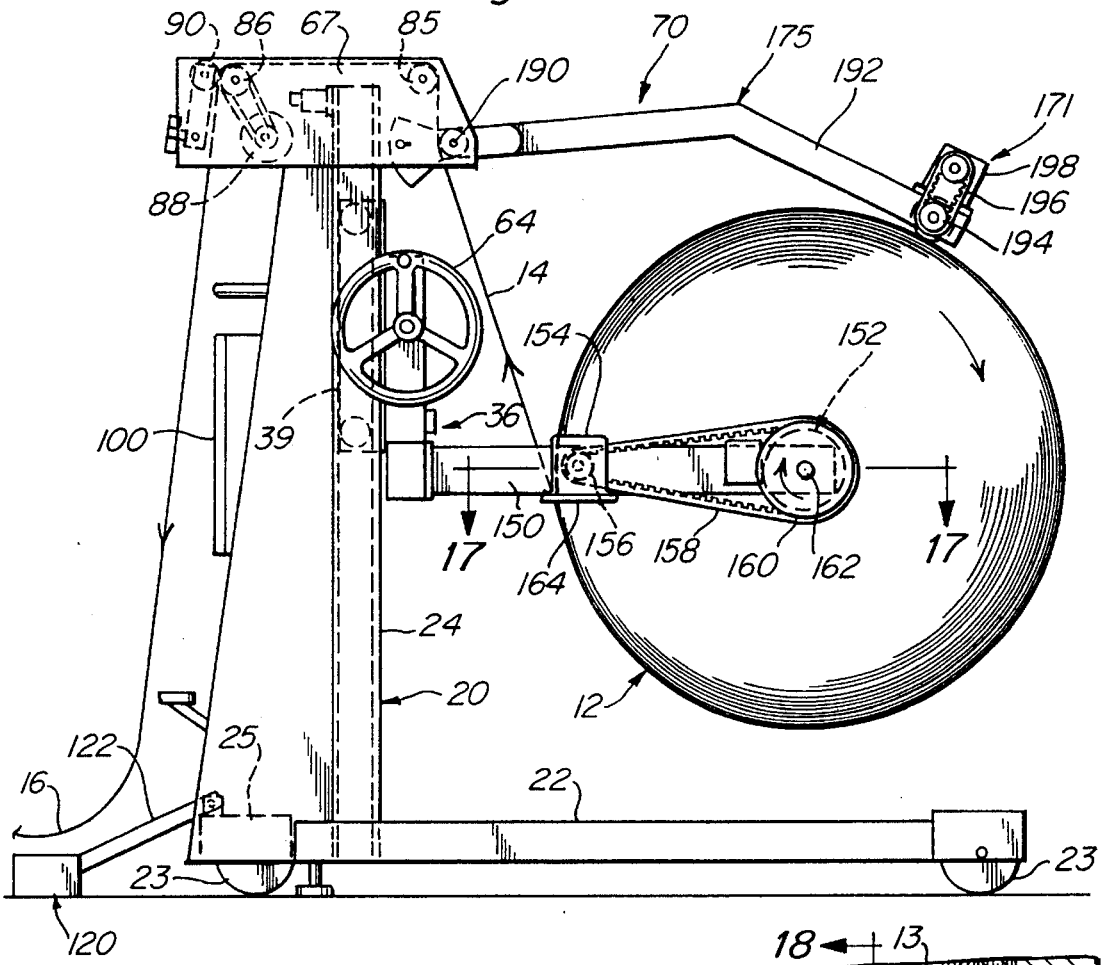
FIG. 16 is a side view of another alternative embodiment in which the chuck is driven directly and roll speed is detected by a roll surface mounted detector.

An alternative embodiment for a roll support apparatus is shown in FIG. 16. The support stand according to this embodiment includes a number of elements identical to those depicted for the embodiment of FIG. 1. Thus, where reference numbers are the, same as those in FIG. 1, it should be assumed that these, elements match those in FIG. 1. In this embodiment, however, the movable carriage 36 carries a pair of support arms 150 each carrying upon their ends a chuck 152 that engages a respective open end of a core of the roll 12. Upon one of the support arms 150 is firmly mounted a drive motor unit 154 having controllable rotational speed. The drive motor carries upon its end a drive pulley 156 that may be notched to accept a timing-style notched drive belt 158. The drive belt is firmly connected to a drive pulley 160 which is itself interconnected by a shaft through the support arm 150 to one of the chucks 152. In this way, the drive motor 154 may provide direct rotational motion to the roll 12 in the region of the chucks.

The drive motor unit 154 maintains a proper speed by means of a roll perimeter mounted sensing unit 171. The unit 171 is mounted upon an outlying end of an arm 192 pivoted at its opposed end from the plates 67 of the elongated support member 70. The pivot 190 includes a roller for guiding the web between the roll 12 and support member 70. The arm 192 in this example is shaped with an angle 175 so that the perimeter mounted detection unit 171 rides roughly along the tangent of the roll as the roll changes diameter due to transfer of web therefrom. The detector unit 171 itself is sufficiently heavy to maintain .continual surface contact upon the roll perimeter.

The unit 171 comprises a contacting roller 194 disposed proximate to the roll 12 that experiences rotational displacement as the roll rotates. The contacting roller 194 is interconnected with a potentiometer 198 by means of a notched timing-style belt 196. The potentiometer 198 transmits signals to a circuit similar to that shown in FIG. 15 from which speed and torque of the roll 12 may be determined. From this data, the system accurately controls the speed of the direct drive motor unit 154.

Figure 17:
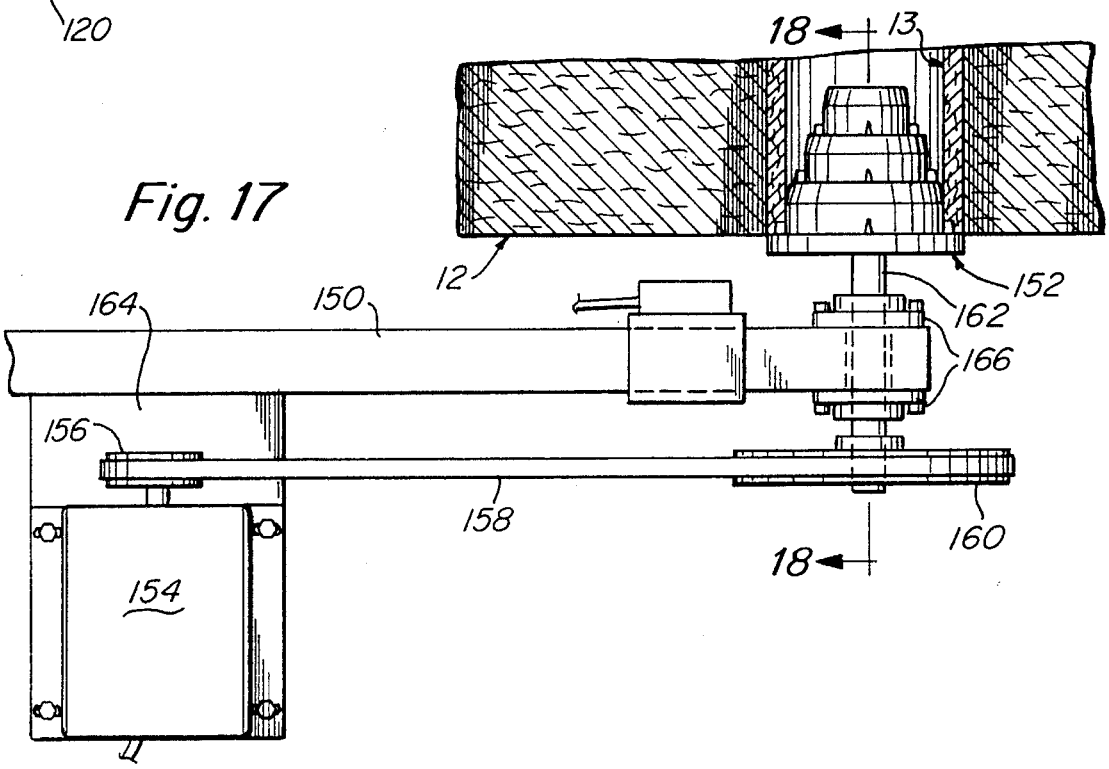
FIG. 17 is a partial top view of an arm, variable diameter tiered chuck and chuck drive member taken along line 17—17 of FIG. 16.

A partial top view of the direct drive arrangement of FIG. 16 appears in FIG. 17. In this view, the base 164 for supporting the drive motor upon the support arm 150, is clearly visible. A bearing assembly 166 disposed upon the end of the arm 150 carries the shaft 162 connected between the driving pulley 160 and the chuck 152. The bearing should prevent axial translation of the shaft so that as the arms are brought tightly against opposing ends of the roll core 13, the core is firmly engaged by the chucks.

Figure 18:
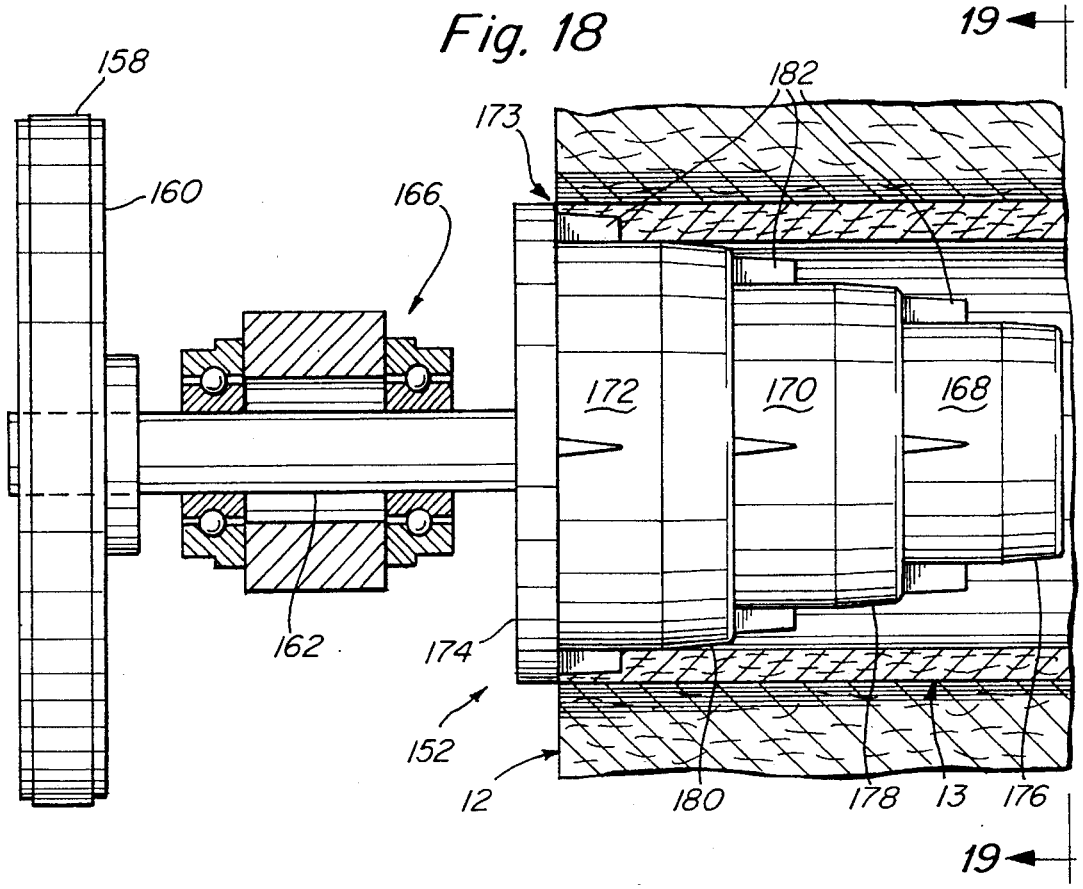
FIG. 18 is a partial exposed top view taken along line 18—18 of FIG. 17 detailing the tiered chuck construction.
Figure 19:
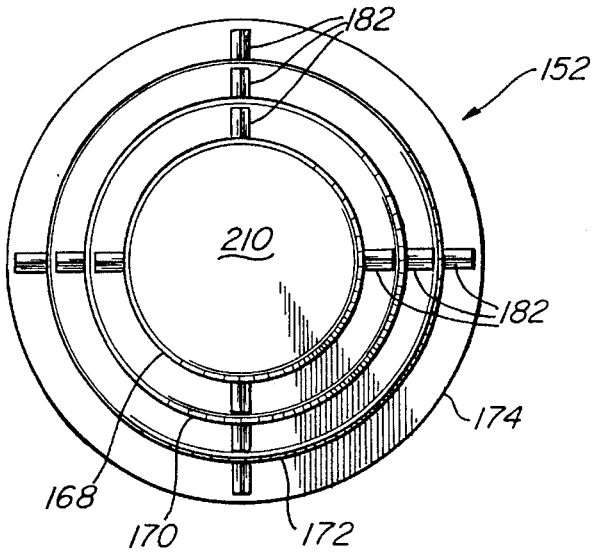
FIG. 19 shows a front view of the chuck of FIG. 18 taken along line 19—19.

One type of chuck 152 along with its driving shaft 162, is detailed in FIGS. 18 and 19. The chuck 152 comprises, according to this embodiment, three increasing diameter tiered concentric cylinders 168, 170, 172. The smallest diameter cylinder 168 is disposed at the outer most position from the arm, while the largest diameter cylinder 172 is disposed proximate to the drive shaft and arm. In this way, the chuck can engage a roll core, which overlays a given diameter cylinder, with the open edge of the roll core 173 butted against the outwardly facing (into the roll core from the arm) wall of the next largest diameter cylinder. The larger diameter, outwardly facing wall in this case is an end flange 174. However, for smaller diameter roll cores the end wall may abut the face of the next increasing diameter cylinder. In this way, a multiplicity of roll core diameters (in this example three) may be accommodated by the support apparatus.

Note that each cylinder 168, 170, 172 includes upon its outlying end a frusto-conical tapered edge 176, 178, 180, respectively that narrows in an outwardly facing direction. This tapered edge ensures that the roll core of a given diameter seats quickly and easily onto the cylinder.

Additionally, The center region 210 (see FIG. 19) of this chuck 152 may be hollowed towards the outer end away from the shaft 162 end. This serves to lighten the chuck weight and give access to recessed bolts or other fasteners for holding the chuck 152 to the shaft 162.

Since the chuck 152 is intended in this example for direct drive, it includes elements designed to provide a firm grip on the core to prevent rotational slippage. Specifically, a group of spikes 182 is disposed along the perimeter of each cylinder 168, 170, 172 at 90° intervals. The spikes are sharp in the outwardly facing direction and flare as They meet with the face of the next largest diameter cylinder (or flange 174 in the case of the largest cylinder 172). As shown in FIG. 18, when the chucks are forced into the roll core 13 open end, each of the spikes embeds itself into the roll core surface. Of course, a relatively soft roll core must be utilized to enable such embedding. The embedded spikes 182 serve to provide sufficient grip so that all rotational motion imparted upon the chuck by the drive system will be transferred to the roll without any slippage between the roll core and chuck 152.

Figure 20A:
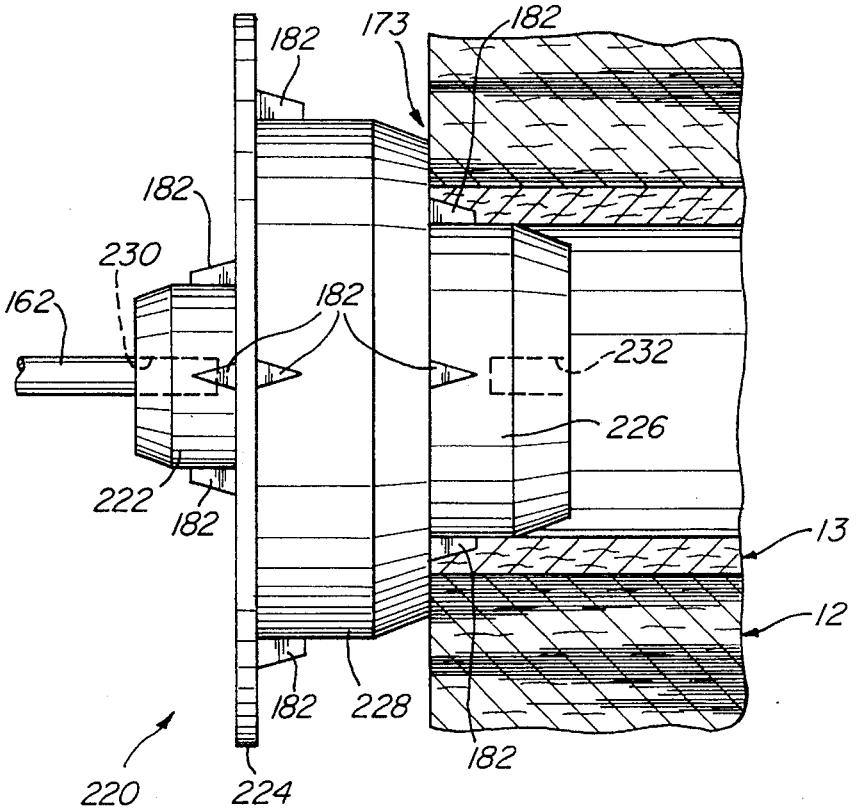
FIG. 20A shows a side view of an alternative embodiment of the tiered chuck arrangement of FIG. 17 capable of accepting a shaft upon either end to reduce space.
Figure 20B:
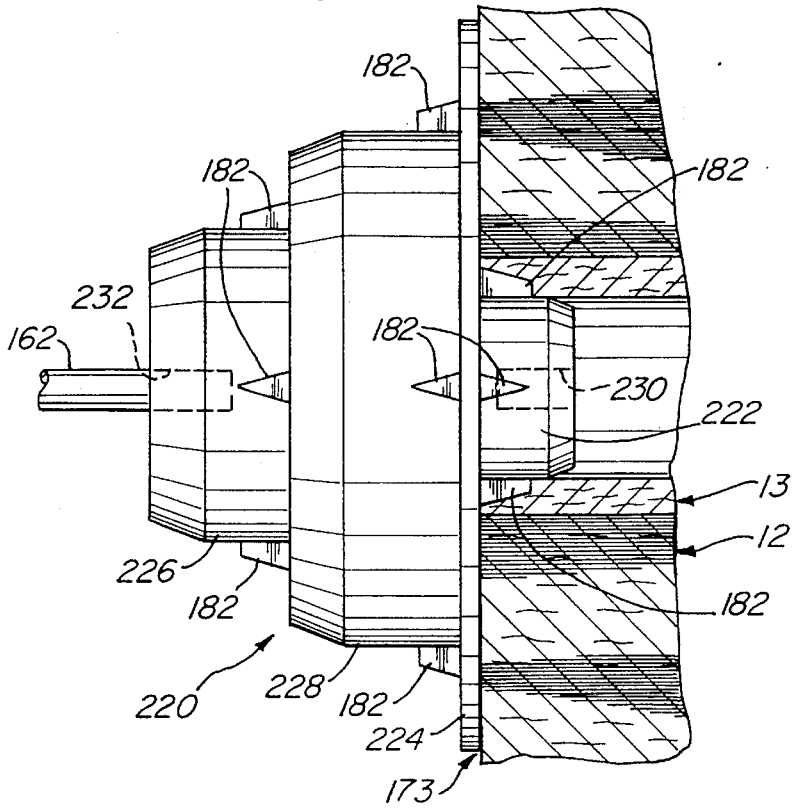
FIG. 20B shows the chuck of FIG. 20A with the chuck inverted so that an opposing side faces the shaft.

A second tiered chuck 220 design is illustrated in FIGS. 20A and 20B. The concept of increasing diameter nested cylinders is similar to that shown for the chuck of FIGS. 18 and 19. The use of gripping spikes 182 is also similar. However, this chuck 220 carries its smallest diameter cylinder 222 upon a side of the flange 224 opposite that of the next larger 226 and largest 228 nested cylinders. As illustrated alternatively in FIGS. 20A and 20B, the chuck 220 may be mounted upon the shaft 162 upon either of its sides to access the appropriate sized cylinder. Mounting is particularly accomplished by a suitable orifice 230, 232 (shown in phantom) located upon each side of the chuck 220. By placing cylinders upon opposing flange 224 sides, the smallest, outermost cylinder may be brought significantly closer to the arm 150, reducing shaft 162 stresses from heavy material rolls. Of course additional nesting of various size diameter cylinders may be accomplished on opposing sides of the flange 224 according to this embodiment.

Figure 21:
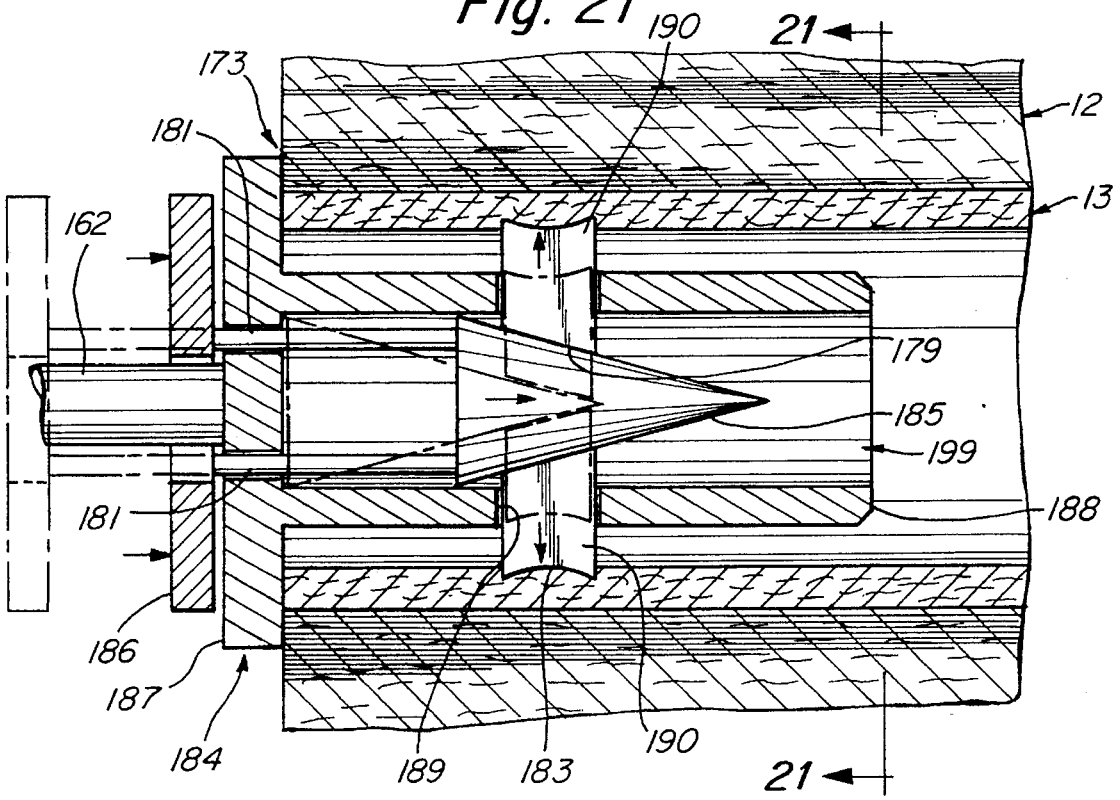
FIG. 21 is a cross-sectional top view of an alternative embodiment of a variable diameter chuck according to this invention having dynamically variable projections.
Figure 22:
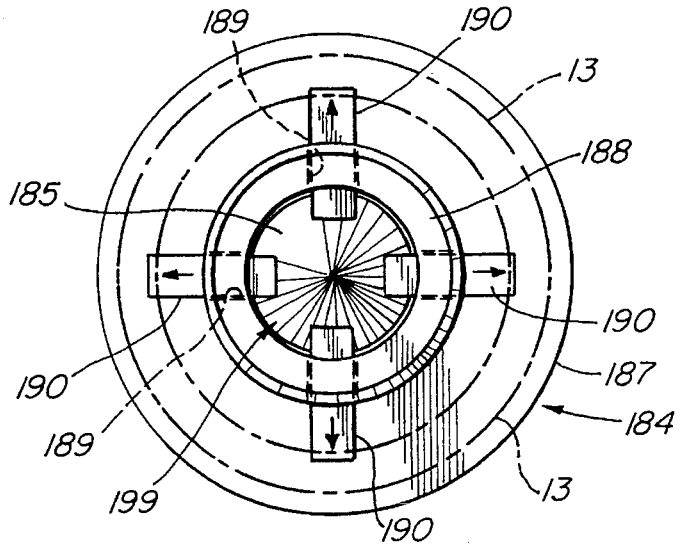
FIG. 22 is a front view of the chuck of FIG. 19 taken along line 21—21.

Another alternative design for a chuck capable of firmly gripping a roll core and also capable of accommodating various size roll cores appears in cross-sectional view in FIG. 21 and in front view in FIG. 22. The chuck 184 of this example includes a group of retracting projections 190 disposed about the outer perimeter of a single diameter cylinder 188 at, in this example, 90° intervals. Rectangular orifices 189 cut completely through the cylinder 188 seat each of the projections. The projections 190 include an outer surface having a dished-in shape 183 that, when contacting the inner surface of a roll core 13, dig in to grip the core. In this manner, rotational torque transferred by the drive shaft 162 is fully transmitted to the roll core 13. The chuck, like the tiered chuck 152 (FIGS. 17–19), includes a rear flange 187 that butts against an outlying edge 173 of the roll 12 and core 13. Although the extension and retraction of the projections 190 may be accomplished by a variety of means including hydraulic pressure injected into the cylinder, the actuation mechanism according to this example utilizes a moving cone 185 disposed within the hollow center region 199 of cylinder 188. The surface of the cone 185 engages angled inner edges 179 of each of the projections as the cone slides forwardly (away from the arm). Thus, axial pressure upon the cone results in radial pressure upon each of the projections forcing them through the orifices 189 outwardly from the surface of the cylinder 188. The cone 185 itself is secured upon the drive shaft 162 by means of a tubular sleeve 181 that rides over the drive shaft 162. Upon the end of the sleeve 181 opposite the cone 185, is positioned a base 186. This base 186 may be connected to a set of linear motors, a hydraulic system or similar force/pressure inducing device (not shown).

While the cone 185 is shogun in a relatively fully extended position, less extended positions may be utilized for gripping smaller diameter roll cores. The fully retracted position of the cone is shown in phantom. In the fully retracted position, the projections would appear fully withdrawn into the cylinder, allowing a roll core of like or slightly larger diameter than the cylinder 188 to pass over it without interference. As may be seen, one advantage of this embodiment is that the projections 190 may be adjusted to any size between fully retracted and fully extended diameters. Thus, the chuck 184 of this example may be universally adaptable to any diameter core within a predetermined range.

Figure 23:
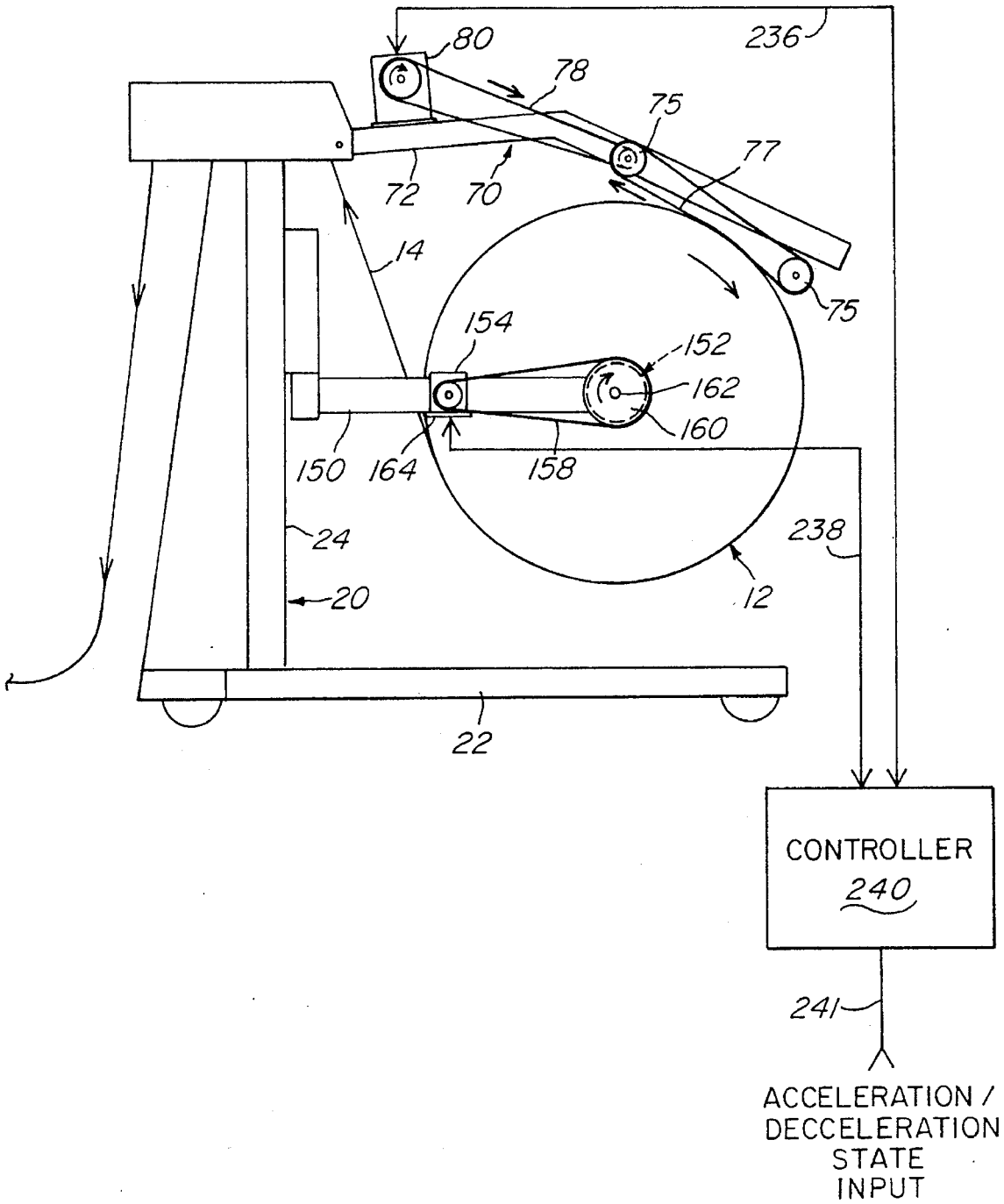
FIG. 23 is a schematic side view of another alternative embodiment in which the chuck is driven directly and the periphery of the roll is also driven simultaneously.

Finally, the concepts of direct chuck drive and roll perimeter drive may be brought together in one embodiment as shown in FIG. 23. This schematic view illustrates a driven chuck 152 connected by means of a drive belt 158 to an arm mounted motor 154. A second belt drive 77 is mounted over the roll 12 perimeter on a weighted swinging arm 72 such as shown in FIG. 1. The belt drive 77 contacts the roll 12 perimeter to drive it. As discussed above the belt drive 77 is connected to a driving motor 80 also mounted upon the swinging arm 72.

By utilizing both types of drive systems, it is possible to optimize the driving of the roll 12 according to this embodiment. In particular, both motors 80, 154 may be electronically coupled (236, 238 respectively) to a controller 240 that receives roll rotational speed information from the motors, other parts of the system, or both and processes this information to determine the current state of rotation. If the roll requires rotational acceleration, the system directs the majority of power to the perimeter belt drive motor 80 since the belt drive 77 more effectively accelerates the roll 12. If, however the roll requires deceleration, which is more effectively accomplished by core driving, power to develop stopping torque is directed to the core drive motor 154 while the belt drive motor 80 receives just enough power simply to follow the roll 12 movement (freewheeling). In steady state motion, in which neither acceleration nor deceleration is required, power may be distributed to both motors 80, 154 relatively evenly by the controller 240. The exact power distribution may be determined experimentally for a given system and roll. Alternatively, either of the motors may be driven in a steady state condition with the other remaining inactive.

The controller 240, illustrated in FIG. 23 is considered to be substantially of conventional design. Note in FIG. 23 the input-line 241 that is representative of some type of input that might be a manually derived input for controlling either acceleration or deceleration (stopping).

In one instance a particular signal on line 241 can be indicative of acceleration in which case the controller 240 provides primary control to the drive belt with the center drive a freewheeling or operating at a minimum drive. Alternatively, a signal on line 24 might operate the controller 240 for stopping in which instance the controller 240 sends a signal for primary stopping to the center core drive member while permitting the belt drive to essentially freewheel.

Having now described a preferred embodiment of the present invention along with certain modifications thereof, it should now be apparent to those skilled in the art that other modifications and other embodiments will also fall within the scope of the present invention as defined by the pending claims.

What is claimed is:

1. Apparatus for supporting and manipulating web material transferred between a roll having a support core and a utilization device, said apparatus comprising:

a frame having a base with wheels for support and movement of the frame so as to make the frame portable, and an upright support extending from said base, a pair of spacedly disposed arms that include rotating support structures that receive a roll core wherein the roll core rotates on an axis relative to the arms, the arms extending from the upright support in a spaced apart relative parallel position and disposed over the base, a drive member positioned so that it engages the web material roll to drive the roll, a support member that supports the drive member relative to the frame, a roller assembly that contacts the web material to support and guide the web material between the web material roll and the utilization device, the roller assembly being attached to the upright support and the web material extending therefrom into a loop of web material that is free of contact over a portion thereof, a controller that senses the movement of the web material in the loop between the web material roll and the utilization device to, in turn, control the rate of the drive means, and wherein the wheels are positioned on the base at locations that are forward, taken in a direction away from the upright support, of the axis of rotation of the roll and are outward relative to edges of the web material in the roll to stabilize the base when the roll is mounted in the arms.

2. A method for supporting and feeding web material between a roll having a support core and a utilization device comprising the steps of:

providing an upright support on a base having wheels so that the base is portable;

rotatably supporting a roll of web material on arms that extend over the base from the upright support;

directing web between the roll and utilization device including locating the web over a guiding structure on the upright support;

providing a loop of web material that is suspended substantially free of engagement along a portion thereof between the upright support and the utilization device including tensioning the web with a predetermined tensioning force to maintain the loop;

driving the roll by engaging the roll in response to a sensed size of the loop so that a predetermined range loop size is maintained as the web material is transferred between the utilization device and the roll; and wherein the tensioning includes applying the predetermined force to the web to maintain the loop when the roll is both driven and maintained substantially stationary whereby tension on the web is substantially continuously maintained.

3. The method as set forth in claim 2 wherein the step of driving includes providing a pivotally mounted drive member over the roll and engaging the roll with the drive member by action of gravity.

4. The method as set forth in claim 3 wherein the step of providing a pivotal drive, member includes engaging the periphery of the roll with a drive belt that rotates the roll to drive the roll.

5. The method as set forth in claim 2 further comprising supporting the upright support on a base having wheels that extend outwardly beyond edges of the roll and forwardly of an axis of rotation of the roll relative to the upright support.

6. The method as set forth in claim 2 wherein the step of driving includes sensing a size of the loop with an ultrasonic sensor substantially disposed between the loop and a floor surface.

7. The method as set forth in claim 2 further comprising providing a pair of arms that are movable on the upright support and are movable toward and away from each other to engage and to disengage the roll, respectively.

8. The method as set forth in claim 7 further comprising providing arms that are movable upwardly and downwardly along the upright support.

9. The method as set forth in claim 2 further comprising providing a selectively engageable stop that secures the base relative to the floor.

10. A method for supporting and feeding web material between a roll having a support core and a utilization device comprising the steps of:

providing a frame having a base that is movable about a floor surface and an upright support extending from the base;

rotatably supporting a roll of web material having a roll core on a pair of arms that extend from the upright support and over the base;

driving the roll by engaging a periphery of the roll by a pivotable drive member that is maintained in contact with the roll by gravity;

guiding web material between the roll and the utilization device on the upright support, the step of guiding including providing a tension to the web to maintain a substantially tension-free loop between the roll and the utilization device; and controlling the step of driving based upon a draw of web material between the roll and the utilization device including continuously maintaining the tension-free loop therebetween.

11. The method as set forth in claim 10 further comprising moving the frame about the floor surface and selectively locking the frame at a predetermined position on the floor surface.

12. The method as set forth in claim 11 wherein the step of locking includes providing a movable stop that selectively engages the floor upon actuation thereof.

13. The method as set forth in claim 10 wherein the step of controlling includes sensing a size of the tension-free loop and controlling the step of driving based upon the size of the tension-free loop so that the size of the tension-free loop is maintained within a predetermined size range.

14. The method as set forth in claim 13 wherein the step of sensing includes providing a sensor that is free of contact with the loop.

15. The method as set forth in claim 14 wherein the step of providing the sensor comprises providing an ultrasonic sensor located between the floor surface and the tension-free loop.

16. The method as set forth in claim 10 wherein the step of tensioning comprises engaging the web material with a torque roller that provides a tension to the web material when the web material is stationary and is in motion.

17. The method as set forth in claim 10 further comprising supporting the web material on a support structure that extends outwardly from the upright support opposite a direction of extension of the pair of arms.

18. The method as set forth in claim 10 wherein the step of providing a base includes supporting the base on wheels that are located outwardly, relative to the upright support, from an axis of rotation of the roll and are located outwardly, taken in a direction parallel to the axis of rotation from edges of the roll to stabilize the frame on the floor surface.

* * * * *